US011297915B1

(12) United States Patent
Booth et al.

(10) Patent No.: US 11,297,915 B1
(45) Date of Patent: Apr. 12, 2022

(54) AIRPLANE TRAY COVER MULTI-COMPARTMENT HOLDER SYSTEM AND METHOD

(71) Applicant: QBSleeves, Inc., White Plains, NY (US)

(72) Inventors: Barbara J. Booth, Saddle River, NJ (US); Cornelia J. Klenk-Quinn, Ossining, NY (US)

(73) Assignee: QBSleeves, Inc., White Plains, NY (US)

( * ) Notice: Subject to any disclaimer, the term of this patent is extended or adjusted under 35 U.S.C. 154(b) by 0 days.

(21) Appl. No.: 17/113,903

(22) Filed: Dec. 7, 2020

(51) Int. Cl.
*A45C 5/06* (2006.01)
*A45C 7/00* (2006.01)
*A45C 5/08* (2006.01)

(52) U.S. Cl.
CPC ..... *A45C 5/06* (2013.01); *A45C 5/08* (2013.01); *A45C 7/005* (2013.01); *A45C 2200/10* (2013.01)

(58) Field of Classification Search
CPC .. A45C 5/06; A45C 5/08; A45C 7/005; A45C 2200/10
See application file for complete search history.

(56) References Cited

U.S. PATENT DOCUMENTS 2,191,180 A 2/1940 Reaume
2,297,941 A 10/1942 Cleary
2,588,232 A 3/1952 Grant
3,397,771 A * 8/1968 Fogle ..... B65D 85/187 206/750
3,880,342 A * 4/1975 Longo, Jr. ..... B65D 5/02 229/115
4,742,917 A 5/1988 Bornwasser
4,826,016 A 5/1989 Foster
4,859,084 A * 8/1989 Kaumeyer ..... A63B 57/00 383/39
5,036,978 A 8/1991 Frank
5,291,990 A * 3/1994 Sejzer ..... B65D 75/42 206/308.1
5,908,152 A 6/1999 Tullis
(Continued)

FOREIGN PATENT DOCUMENTS

CN 20665190 U 11/2017
CN 20665192 U 11/2017

*Primary Examiner* — Tri M Mai
(74) *Attorney, Agent, or Firm* — Neustel Law Offices

(57) ABSTRACT

An airplane tray cover multi-compartment holder system and method for holding and transporting a plurality of airplane tray covers independent of and isolated from each other. The system and method generally includes a case with a plurality of individual compartments each adapted to hold an individual tray cover or item isolated from the other compartments. Each compartment has a separate door panel that is pivotable between open and closed positions to access an individual tray cover in a compartment. The door panels have windows through which the individual tray covers can be viewed. The tray covers and compartments each have indicia that uniquely identify them. The individual compartments are defined by an arrangement of exterior and interior panels. The exterior panels may have magnetic or other connectors that allow them to be releasably connected with panels of other compartments and cases in various configurations.

14 Claims, 20 Drawing Sheets

(56) References Cited

U.S. PATENT DOCUMENTS

| | | | | |
|---|---|---|---|---|
| 6,244,501 | B1 * | 6/2001 | Choi | B65D 5/009 220/23.2 |
| 6,779,658 | B2 * | 8/2004 | Polloni | B65D 85/10484 206/268 |
| 7,051,899 | B1 | 5/2006 | Offenhauer | |
| 7,143,930 | B2 | 12/2006 | Money | |
| 7,219,797 | B2 | 5/2007 | Kroeze | |
| 7,350,688 | B2 | 4/2008 | Sierra-Gomez | |
| 7,748,904 | B2 | 7/2010 | Henn | |
| 7,841,658 | B1 * | 11/2010 | Marble | B64D 11/0636 297/224 |
| 9,051,087 | B1 * | 6/2015 | Daniels | B60N 3/004 |
| 2004/0011682 | A1 | 1/2004 | Hasemi | |
| 2005/0056688 | A1 | 3/2005 | Hsi-Ching | |
| 2005/0230465 | A1 | 10/2005 | Metzler | |
| 2008/0156833 | A1 | 7/2008 | Espiritu | |
| 2009/0133789 | A1 * | 5/2009 | Hall | B62B 5/06 150/154 |
| 2012/0208171 | A1 | 8/2012 | Gordon | |
| 2014/0263353 | A1 | 9/2014 | Bell | |
| 2015/0305402 | A1 | 10/2015 | Bourgoin | |
| 2016/0353848 | A1 | 12/2016 | Whitaker | |
| 2019/0256253 | A1 | 8/2019 | Van Bree | |
| 2019/0261781 | A1 * | 8/2019 | Hoensheid | A47C 31/11 |
| 2021/0145193 | A1 * | 5/2021 | Presley | A47G 11/004 |

* cited by examiner

FIG. 28
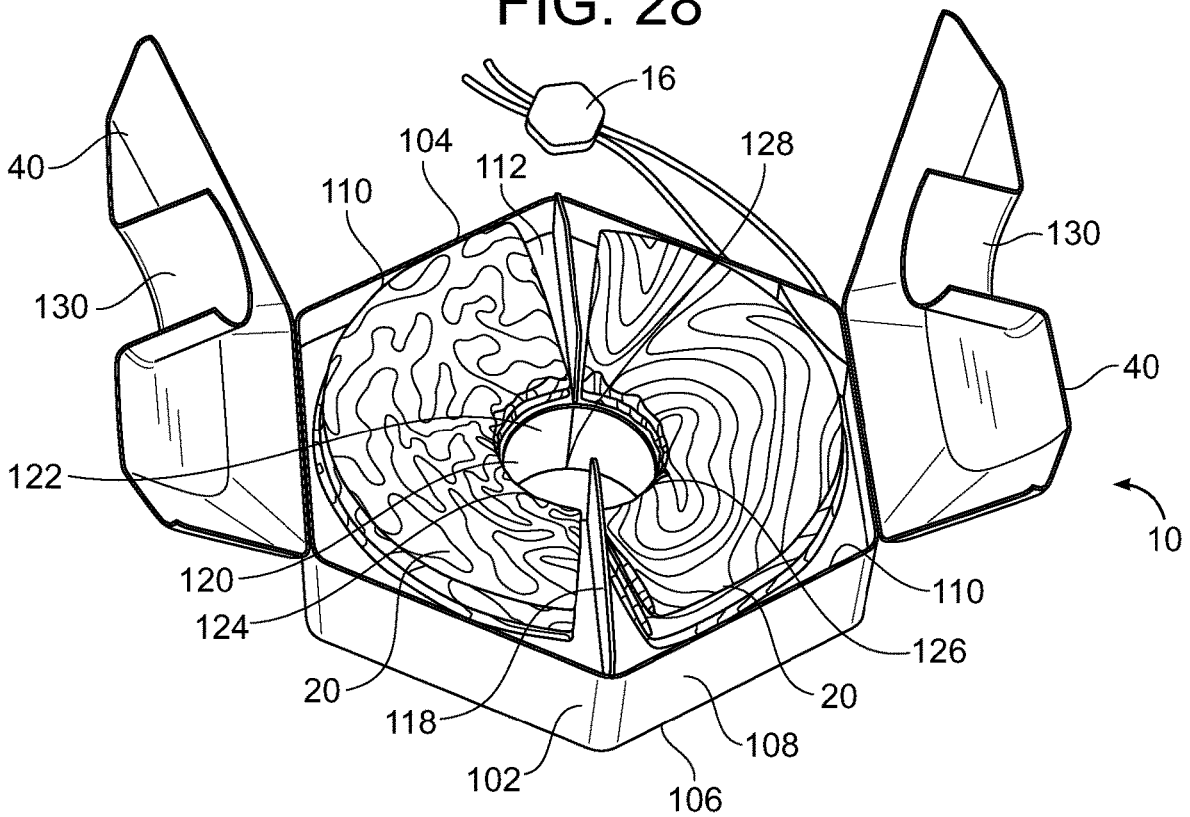
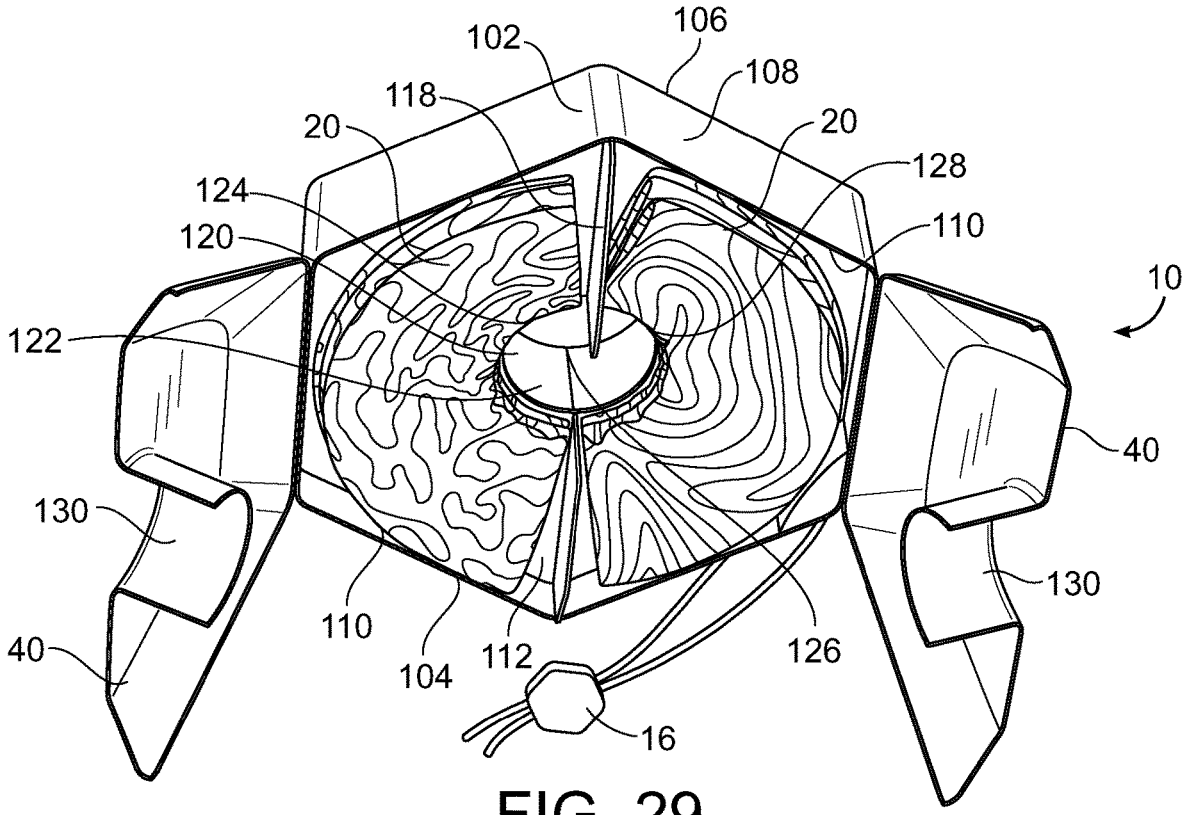
FIG. 29

AIRPLANE TRAY COVER MULTI-COMPARTMENT HOLDER SYSTEM AND METHOD

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to an airplane tray cover multi-compartment holder system and method for holding and transporting a plurality of airplane tray covers or the like independent and isolated from each other.

Related Art

Any discussion of the related art throughout the specification should in no way be considered as an admission that such related art is widely known or forms part of common general knowledge in the field.

Nearly all commercial airplanes today include fold-down seatback tray tables. Such tray tables provide a flat surface to support food and drink that passengers ingest, as well as to support laptop computers, tablets and other devices for work or entertainment. However, recent studies have revealed that the surfaces of airplane seatback trays tend to be the dirtiest spaces on an airplane. For example in one recent study, microorganism concentrations were measured on various surfaces of commercial aircraft. The microorganism concentrations found on seatback tray surfaces averaged 2,155 colony forming units (CFU's), which was eight times higher than the average concentration of microorganisms found on lavatory flush buttons.

A number of potentially-infectious microorganisms are known to be able to survive on exposed surfaces for up to several days. Some such microorganisms can produce symptoms in a person that can range from moderate to severe if the person is infected. One such microorganism that has recently been found to have infected thousands of persons worldwide is the flu-related virus Covid-19.

Several different tray table covers have been developed to cover the surfaces of tray tables in an effort to reduce the exposure of airline passengers to potentially infectious microorganisms. Such covers have tended to be relatively large and bulky with some including pockets. Such covers are typically sold as single units. Accordingly, families traveling together are faced with having to acquire and tote multiple individual covers. This can be inconvenient especially when already dealing with other baggage and perhaps small children. In addition, individual covers can be easily lost. Still further, covers can be exposed to potentially infectious microorganisms in use. Without the ability to identify and isolate individual covers that have been exposed, they can in turn potentially cross-contaminate other individual covers that have not yet been used.

There is a need for an airplane tray cover multi-compartment holder system and method that includes a case for conveniently storing, transporting, and accessing a plurality of individual airline tray covers or the like independent of and isolated from each other. There is a need for such a system and method that includes a case that is durable, lightweight, easily inexpensively constructed, and conveniently-shaped for storage, transportation, and access. There is a need for such a system and method including cases and compartments that are modular and that are capable of being joined with other cases and compartments to form structures for conveniently carrying a number of covers, for example a number sufficient to protect an entire family while avoiding the loss of individual covers. There is a need for such a system and method that includes a case that can be attached to other luggage for convenient transportation. There is a need for such a system and method that includes a case that has separate compartments that are separately openable and closable for storing, transporting, and accessing individual covers independent of and isolated from each other. There is a need for such a system and method that includes a case that has separate compartments with the ability to view covers that may have indicia uniquely identifying them to facilitate selection of an individual cover without opening a compartment. There is a need for such a system and method that includes a case with an openable door or panel with a feature to hold a portable electronic device in a position suitable for viewing when the door panel is in an open position. There is a need for such a system and method that includes a case with compartments that include indicia uniquely identifying the compartments to facilitate returning used covers to the same compartments from which they came.

SUMMARY

An example embodiment is directed to an airplane tray cover multi-compartment holder system and method that generally includes a case of a size that is permitted to be carried aboard a commercial airplane and that has an interior space with a plurality of separate compartments each adapted to hold an individual tray cover or other item isolated from the other compartments. The case comprises a bottom panel, a plurality of door panels separately pivotally attached to the bottom panel, first and second end panels on the bottom panel, and a plurality of divider panels on the bottom panel with the various arranged to define the interior space and the plurality of separate compartments of the case. Each compartment may have a visual indicia that uniquely identifies the compartment. Each door panel corresponds to a compartment and is separately pivotable between an open position and a closed position to selectively open and close the corresponding compartment for accessing the individual tray cover therein. According to one aspect of the example embodiment, the case may be constructed from a substantially flat blank of foldable material.

Each door panel comprises a connector adapted to releasably hold the door panel to the case in the closed position. Each door panel also may comprise a window through which the individual tray cover in a corresponding compartment can be viewed. At least one of the tray covers in the compartments may have an indicia that can be made visible through the window and that uniquely identifies the tray cover. At least one door panel may include a support for supporting an electronic device in a position suitable for viewing when the door panel is in the open position.

According to an aspect of the example embodiment, the case has a substantially triangle-shape cross-section with the bottom panel corresponding to the base of the triangle and at least one door panel corresponding to each side of the triangle. At least one of the first and second end panels may include a connector adapted to releasably connect the end panel with a corresponding end panel of another case to form a multi-case structure. Similarly, the bottom panel may include a connector adapted to releasably connect the bottom panel with a corresponding bottom panel of another case to form a multi-case structure.

According to another aspect of the example embodiment, the case includes an elongated substantially flat bottom panel having a first end, a second end opposite the first end, a first side edge, and a second side edge opposite the first side edge. The case also includes a plurality of first door panels separately pivotally attached to the bottom panel at or near the first side edge, and a plurality of second door panels separately pivotally attached to the bottom panel at or near the second side edge. The case further includes a first end panel attached to the bottom panel at or near the first end and a second end panel attached to the bottom panel at or near the second end and facing the first end panel. The case further includes a first divider panel that extends between the first end panel and the second end panel and the first divider panel has a top portion, a first side and a second side opposite of the first side. The case further includes a second divider panel that extends substantially transversely across the first divider panel between the first side edge and the second side edge of the bottom panel. The panels are arranged to define a plurality of separate first compartments along the first side of the first divider panel and a plurality of separate second compartments along the second side of the first divider panel. Each first door panel is separately pivotable between an open position and a closed position to selectively open and close one of the first compartments for accessing the individual tray cover therein, and each second door panel is separately pivotable between an open position and a closed position to selectively open and close one of the second compartments for accessing the individual tray cover therein.

The top portion of the first divider panel may have a first connector corresponding to a first connector of each first door panel and a second connector corresponding to a second connector of each second door panel. The corresponding first connectors of the first divider panel and each first door panel are adapted to releasably hold each first door panel in the closed position with the top portion of the first door panel adjacent to the top portion of the first divider panel. The corresponding second connectors of the first divider panel and each second door panel are similarly adapted to releasably hold each second door panel in the closed position with the top portion of the second door panel adjacent to the top portion of the first divider panel.

According to another aspect of the example embodiment, the case has a substantially triangle-shape cross-section and the bottom panel corresponds to the base of the triangle, the first divider defines the height of the triangle, the plurality of first door panels correspond to one side of the triangle, and the plurality of second door panels correspond to the other side of the triangle.

Another example embodiment is directed to an airplane tray cover multi-compartment holder system and method that generally includes a case of a size that is permitted to be carried aboard a commercial airplane and that comprises a plurality of releasably connectable individual modular compartments each adapted to hold an individual tray cover or other item isolated from the other compartments. Each individual modular compartment comprises a bottom panel with a first end portion, a second end portion opposite the first end portion, a first side extending between the first end portion and the second end portion, and a second side opposite the first side extending between the first end portion and the second end portion. Each modular compartment also comprises a first end panel at or near the first end portion of the bottom panel and a second end panel at or near the second end portion of the bottom panel with the end panels facing each other. Each modular compartment further comprises a back panel that extends along the first side of the bottom panel between the first end panel and the second end panel, and a door panel that faces the back panel and extends along the second side of the bottom panel between the first end panel and the second end panel. The door panel is pivotally attached to the bottom panel, and is pivotable between an open position and a closed position to selectively open and close the compartment for accessing the individual tray cover therein. Each of the back panel, the first and second end panels, and the bottom panel includes a connector adapted to releasably connect the modular compartment to another modular compartment of the case.

According to an aspect of the example embodiment, the case can have four modular compartments each with a substantially triangle-shape cross-section releasably connected together so that the case has a substantially quadrangle-shape cross-section.

There has thus been outlined, rather broadly, some of the embodiments of the airplane tray cover multi-compartment holder system and method in order that the detailed description thereof may be better understood, and in order that the present contribution to the art may be better appreciated. There are additional embodiments of the airplane tray cover multi-compartment holder system and method that will be described hereinafter and that will form the subject matter of the claims appended hereto. In this respect, before explaining at least one embodiment of the airplane tray cover multi-compartment holder system and method in detail, it is to be understood that the airplane tray cover multi-compartment holder system and method is not limited in its application to the details of construction or to the arrangements of the components set forth in the following description or illustrated in the drawings. The airplane tray cover multi-compartment holder system and method is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

FIG. 28 is a top perspective view of an airplane tray cover multi-compartment holder system and method in accordance with another alternative example embodiment illustrating a toroidal-shape multi-compartment case with two door panels open.

FIG. 29 is a bottom perspective view of an airplane tray cover multi-compartment holder system and method in accordance with another alternative example embodiment illustrating a toroidal-shape multi-compartment case with two door panels open.

DETAILED DESCRIPTION

Figure 1:
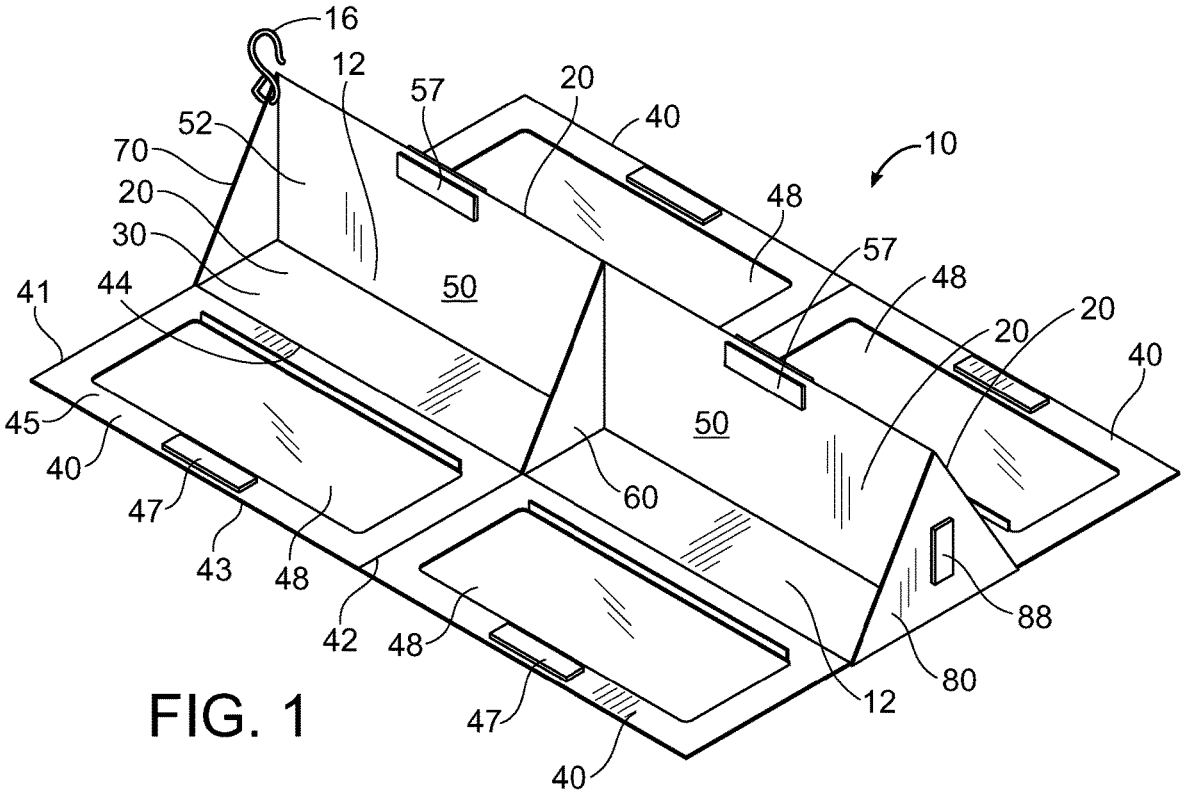
FIG. 1 is a perspective view of an airplane tray cover multi-compartment holder system and method in accordance with an example embodiment illustrated with door panels of a multi-compartment case in an open state.

A. Overview.

Example embodiments of an airplane tray cover multi-compartment holder system and method generally comprise a case 10 with a plurality of individual compartments 20. The case 10 is generally of a size that is permissible to be carried aboard a commercial airplane. Each individual compartment 20 is adapted to hold an individual tray cover or other item independent of and isolated from the other compartments 20 and the individual tray covers or other items therein.

Individual tray covers are generally of a type adapted to fit over fold down seat back tray tables of commercial aircraft in order to prevent contact with microorganisms on the surfaces of the tray tables. Individual tray covers may be provided with indicia that uniquely identify them and distinguish them from other tray covers. Other items may include desk covers, gaiters, face masks, or the like.

In one example embodiment, the case 10 comprises a bottom panel 30, a plurality of door panels 40, a first divider panel 50, a second divider panel 60, a first end panel 70, and a second end panel 80. The bottom panel 30, first and second divider panels 50, 60, and first and second end panels 70, 80 are configured and arranged to define an interior space 12 of the case 10 and to divide the interior space 12 into the individual compartments 20.

Each individual compartment 20 has a corresponding door panel 40. Each door panel 40 is separately pivotably connected to the bottom panel 30 and is selectively pivotable between open and closed positions to enable a user to insert and access an individual tray cover or other item from the corresponding individual compartment 20. A connector 47 on the door panel 40 and a corresponding connector 57 on the case 10 releasably hold the door panel in the closed position. Each door panel 40 has a window element 48 for viewing the interior of the corresponding compartment and the contents thereof without opening the door panel 40.

Indicia are provided on each individual compartment 20 to uniquely identify the compartment 20 and distinguish it from other compartments 20. This facilitates returning a used tray cover or item that may be contaminated to the same compartment 20 from which it was retrieved and avoid cross-contaminating other tray covers or items.

The case 10 has a substantially triangle-shape exterior profile and a triangle-shape cross-section and each of the individual compartments 40 is substantially triangle-shaped. The bottom panel 30 corresponds with the base of the triangle, the height of the first and second divider panels 50, 60 and the first and second end panels 70, 80 correspond to the height of the triangle, and the door panels 40 and side edges of the second divider panel 60 and the first and second end panels 70, 80 correspond to the sides of the triangle.

Each of the bottom panel 30 and the first and second end panels 70, 80 have connectors 88 such as magnets that enable the case 10 to be releasably connected with other cases 10 in a bottom-to-bottom and/or end-to-end fashion to form multi-case structures. Depending on the specific triangle-shape cross sections of the cases 10, e.g., isosceles or equilateral, and how they are interconnected, various multi-case configurations can be formed including elongated triangle-shapes, diamond- or prism-shapes, and square- or other quadrangle-shapes.

In another example embodiment, the case 10 comprises a plurality of individual modular compartments 20 that are inter-connected to form the case 10. Each individual modular compartment comprises a base panel 30, a door panel 40, first and second end panels 70, 80, and a back panel 90. The base panel 30, first and second end panels 70, 80, and back panel 90 are configured and arranged to define the interior space 12 of the compartment 20.

The door panel 40 is pivotably connected to the bottom panel 30 and is selectively pivotable between open and closed positions to enable a user to insert and access an individual tray cover or other item from the compartment 20. A connector 47 on the door panel 40 and a corresponding connector 57 on the back panel 90 releasably hold the door panel 40 in the closed position. The door panel 40 has a window element 48 for viewing the interior of the compartment 20 and the contents thereof without opening the door panel 40.

The modular compartment 20 has a substantially triangle-shape exterior profile and a triangle-shape cross-section. Each of the bottom panel 30, the first and second end panels 70, 80, and the back panel 90 have connectors 88 such as magnets that enable the individual modular compartment 20 to be releasably inter-connected with other individual modular compartments 20 in a bottom-to-bottom, back-to-back, and/or end-to-end fashion to form the case 10 in a variety of shapes and sizes, and with a variable number of compartments 20 and a variable amount of interior space. Depending on the specific triangle-shape cross-section of the individual modular compartment 20, e.g., isosceles or equilateral, and how the modular compartments 20 are interconnected, the case 10 can be formed in various configurations including elongated triangle-shapes, diamond- or prism-shapes, and square- or other quadrangle-shapes.

B. Tray Table Covers.

The example embodiments described herein are particularly suitable for use to hold, transport, and access covers of the type used to cover fold-down seatback tray tables commonly found on commercial airplanes. The example embodiments will be suitable for use with a wide variety of such covers that are relatively light and that can be configured in a relatively compact form.

A particularly preferred form of tray table cover with which the example embodiments are suitable for use is a light-weight sleeve-type cover preferably comprising a stretchy material. Such covers are readily foldable or rollable into a compact form for storage or transportation and are readily expandable to a substantially flat configuration roughly the size of a fold-down tray table for use.

Such covers typically will include two opposing sheets of material that are roughly the shape and size of the surface of a tray table that is to be covered, e.g, rectangular or square. The opposing sheets of material are sewn or otherwise joined along opposite sides leaving one or both opposite ends open. In typical use an open end of the cover is slipped over a tray table in its lowered substantially horizontal position with the opposing sheets of material covering the upper and lower surfaces of the tray table respectively. When the cover comprises a stretchy material, the material may contract somewhat to fit snugly around the tray table and prevent slippage. A cover may also include other structural features, such as elasticized edges, to help maintain a proper fit and prevent slippage. The cover may be removed by simply pulling on the opposite end of the cover until the open end is free of the tray table.

A cover may also include a connector element that is adapted to cooperate with a connector on a case 10 as described further below to temporarily and removably adhere or connect the case 10 to the cover when the cover is fitted on a tray table. The case 10 is thus able to be rested on the tray table without sliding off. For example, the cover may include as a connector a magnet that is located and adapted to cooperate with a corresponding magnet on a bottom panel 30 of the case 10 when the cover is fitted over a tray table to releasably hold the case 10 in place on an upper surface of the tray table. Alternatively, the cover and the bottom panel 30 of the case 10 may comprise other forms of corresponding connectors such as Velcro® strips or snaps.

The covers can be made of various materials and fabrics, including a variety of man-made and natural materials and fabrics. It will be appreciated that the materials and fabrics employed preferably will be substantially impervious to the transmission of microorganisms such as bacteria and viruses that may be present on the tray table surfaces. Alternatively or in addition, the materials and fabrics may be pretreated with a suitable antibacterial or antimicrobial agent. Preferably the materials and fabrics will be washable so that the covers can be reused.

The covers can be made in various shapes, sizes, and colors as desired for particular applications. It is particularly contemplated that covers intended for use with the example embodiments as described herein will include indicia 11 capable of uniquely identifying each individual cover in a case 10, which is described further below, and distinguishing it from every other cover in the case 10. The indicia 11 may comprise any indicia that can be sensed by a user to uniquely identify an individual cover and distinguish it from other covers. For example, the indicia 11 may comprise a pattern, a color, an alphanumeric representation, a graphic representation, or any combination thereof.

It will be appreciated from the description herein that while the example embodiments are particularly suitable for use with covers for commercial airplane seatback tray tables as described above, they are also suitable for use with covers for various other tray or table surfaces such as the surfaces of school desks, hospital tray tables, etc. It will also be appreciated that the example embodiments are suitable for use with other items, for example face masks, gaiters, or other face coverings, handkerchiefs, etc. In short, the example embodiments will be suitable for use with many different relatively compact lightweight items where it is desired to conveniently hold, transport, and access the items independent of and isolated from each other for health or other reasons.

C. Multi-Compartment Case.

Each example embodiment of an airplane tray cover multi-compartment holder system and method described herein comprises a multi-compartment case 10 comprising an interior space 12 with a plurality of individual compartments 20 and an exterior surface 14. Each individual compartment 20 is adapted to contain and hold an individual cover or item independent of and separate and isolated from the other individual compartments 20 and the individual covers or items therein to avoid cross-contamination between covers or items that may have already been used and those that have not yet been used.

As described below, different embodiments of the multi-compartment case 10 may comprise different numbers of individual compartments. For example, in embodiments illustrated in FIGS. 1-19 and FIG. 23 the case 10 comprises four individual compartments 20. In another example embodiment illustrated in FIG. 20 the case 10 comprises eight individual compartments. In yet another example embodiment illustrated in FIGS. 21-22, the case 10 comprises a single modular individual compartment which can be connected with other modular individual compartments to form a case with two, four, or more individual compartments.

Regardless of the number of individual compartments 20 it comprises, the case 10 is preferably of a size no larger than is permitted to be carried aboard a commercial airplane, and more preferably of a size capable of being readily carried by hand, within luggage that is of a size permitted to be carried aboard a commercial airplane, or attached to the exterior of such luggage. Most airline standards for luggage that can be carried aboard commercial airplanes presently specify that the luggage can be no larger than 22" in height, 14" in width, and 9" in depth. Accordingly, example embodiments of the case 10 that are configured and dimensioned as described herein will readily fit within luggage that is permitted to be carried aboard. In fact, a plurality of cases 10 configured and dimensioned as described herein will readily fit in luggage that meets the present carry-on standards either as separate cases or releasably connected together to form a modular multi-case structure as described below, depending on how the cases 10 are arranged.

As described below, different embodiments of the multi-compartment case 10 may have different exterior shapes or profiles and different cross-sectional shapes or profiles. For example, in one embodiment illustrated in FIGS. 1-19, the case 10 has an elongated triangle- or prism-shape with a triangle-shape cross-section. In other embodiments illustrated in FIGS. 20 and 23, the case 10 has an elongated quadrangle-shape and cross section. In yet another embodiment illustrated in FIGS. 24-31, the case 10 has the shape of a toroid, more particularly a toroidal polyhedron, and more particularly a toroidal hexahedron (six-sided toroid).

Also as described below, in different embodiments the individual compartments 20 comprising the multi-compartment case 10 may have different shapes. For example, in embodiments illustrated in FIGS. 1-23, the individual compartments 20 each have an elongated triangle- or prism-shape and a triangle-shape cross section. In the embodiments illustrated in FIGS. 24-31, each of the individual compartments 20 is shaped like half of a toroid and more particularly half of a toroidal hexahedron.

A particularly beneficial feature of the multi-compartment case 10 that is applicable to all of the example embodiments is that each compartment 20 preferably has indicia 22 that uniquely identifies it and distinguishes it from the other individual compartments 20 comprising the case 10. The presence of unique indicia 22 on each individual compartment 20 may aid users in selecting and retrieving from the case 10 covers or items that have not already been used and potentially contaminated, and in returning used covers or items to the same compartments 20 from which they were retrieved to avoid cross-contaminating fresh, unused covers or items. For example, indicia 22 may comprise information that identifies an individual compartment 20 is assigned for a cover or item for a particular leg of an itinerary, such as a first outbound leg or a second outbound leg, e.g., "OUT 1" of "OUT 2." Alternatively, indicia 22 may identify an individual compartment 20 is assigned for a cover or item for the first or second return or in-bound leg of an itinerary, e.g., "IN 1" or "IN 2."

The indicia 11 may but need not match the indicia 22 on the individual cover or item that is contained in the compartment 20 as described above. The indicia 11 also may but need not be alphanumeric as in the examples given above. The indicia 11 may comprise any indicia that can be sensed by a user to uniquely identify an individual compartment 20 and to distinguish it from other compartments 20. For example, the indicia may comprise a pattern, a color, an alphanumeric representation, a graphic representation, or any combination thereof.

The individual compartments 20 of the various example embodiments of the multi-compartment case 10 are defined by a plurality of panels and internal dividers as described in more detail below. Another particularly beneficial feature of the multi-compartment case 10 that is applicable to all the example embodiments described herein is that preferably one or more of the panels and/or dividers that defines the individual compartments 20 and that is exposed to the exterior of the case 10 comprises a window element 48. The window element 48 enables a user to view the interiors of individual compartments 20 and the individual covers or items contained therein, including the indicia 11 on the covers or items, without first opening the compartments 20. A user may thus peruse individual covers or items in order to select one without the need to first open the compartments 20 and potentially expose to the environment a cover or item the user ultimately does not select. The user may also determine if a compartment 20 is empty before placing a tray cover or other item in the compartment 20.

The window element 48 may comprise any material that is sufficiently transparent to enable a user to discern the presence or absence of a tray cover or item in a compartment 20. Preferably, the material will also be sufficiently transparent to enable a user to discern the indicia 11 on a tray cover or item in the compartment 20. Suitable materials may include tissue paper and various thin biodegradable plastic films such as acetate, cellophane, etc.

The window element 48 may be formed as an integral part of a panel, for example as a layer or ply of a multi-layer or multi-ply panel. Alternatively, the window element 48 may comprise a separate structure from the panel. In that case, an opening may be formed in the panel and the window element 48 may be connected or attached to the panel and cover the opening. The window element 48 may be connected or attached to the panel using any suitable adhesive, mechanical fasteners or other suitable means.

Yet another beneficial feature of the multi-compartment case 10 that is applicable to all of the example embodiments is that the exterior surface 14 of the case 10 preferably has connected or attached thereto an attachment device 16 such as an s- or other hook, a carabiner, a lanyard, or the like. The attachment device 16 is adapted to releasably attach the case 10 to the exterior or the interior of a user's backpack or other luggage, for example to a hook or strap thereof, for ease of carrying the case 10 during travel.

The case 10 may be constructed of one or more materials that are reusable or disposable. For example, various plastic materials can be used to construct a case 10 that is reusable and that is readily able to be cleaned and sanitized between uses with typical disinfectants such as soap and water or a diluted bleach solution, among others. Depending on the materials used, the case 10 could be washable between uses in a dishwasher or clothes washer. Various other materials such as paperboard or cardboard can be used to construct a case 10 that is readily and inexpensively disposable after a single use. In any case, the materials used to construct the case 10 preferably will be biodegradable or at least recyclable, and preferably upcycled. In addition, whatever materials are used will preferably have sufficient strength and rigidity characteristics to maintain the shape of the case 10 and to resist damage or destruction of the case 10 and its contents during normal contemplated uses.

D. An Example Embodiment of a Multi-Compartment Case.

One example embodiment of an airplane tray cover multi-compartment holder system and method is illustrated in FIGS. 1-19 and comprises a multi-compartment case 10 having an interior space 12 and an external surface 14. The interior space 12 has four substantially triangle-shape individual compartments 20 defined therein. The compartments 20 are arranged so that the case 10 overall has a substantially elongated triangle- or prism-shape exterior profile and a substantially triangle-shape cross-section.

In one particular embodiment, the case 10 preferably measures approximately 8" in length, 2" in width, and approximately 1.7" in height. Each individual compartment 20 preferably measures about 4" in length, 1" in width, and approximately 1.7" in height. It is contemplated and will be appreciated, however, that the above-described dimensions are merely examples and that the case 10 may have other and different dimensions consistent with the objectives and purposes described herein. All such variations are intended to be encompassed within the spirit and scope of the example embodiments described herein.

The four triangle-shape compartments 20 occupy substantially the entire volume of the interior space 12, except for the first and second divider panels 50, 60 described below. Each of the four compartments 20 has substantially the same shape, size, and volume. It will be appreciated however that the case 10 can be configured to have more or fewer compartments 20 present in the interior space 12 and that the compartments 20 can be configured to have different sizes, shapes, and volumes as desired or as necessary for a particular application.

In this example embodiment, the compartments 20 are arranged with two compartments 20 being longitudinally adjacent along a first side of the case 10 and two compartments 20 being longitudinally adjacent along a second side of the case 10 that is opposite of the first side. Each compartment 20 along the first side of the case 10 is located directly across and opposite from a compartment 20 along the second side of the case 10. Each compartment 20 of the case 10 is separate and isolated from each and every other compartment 20 of the case 10 so that each individual tray cover or item in a compartment 20 is isolated from each and every other individual tray cover or item in each and every other compartment 20. This is to avoid cross-contamination between individual tray covers or items in the case 10.

It should be noted that as used herein descriptors such as "isolation," "isolated," "isolating," and other variations thereof are intended to mean that the individual compartments 20 are configured and arranged to prevent the individual tray covers or items therein from coming into physical contact to avoid cross-contamination. However, the use of these descriptors is not necessarily intended to encompass, include, or require all or even other possible characteristics of "isolation," such as air tightness for example, unless otherwise specifically stated.

In this example embodiment, the case 10 is comprised of a bottom panel 30, a plurality of door panels 40, a first divider panel 50, a second divider panel 60, a first end panel 70, and a second end panel 80. The bottom panel 30, the plurality of door panels 40, the first and second divider panels 50, 60 and the first and second end panels 70, 80 are configured and arranged to define the interior space 12 and each of the plurality of separate individual compartments 20 of the case 10 arranged as described above.

1. Bottom Panel.

More specifically, the bottom panel 30 comprises an elongated, substantially planar flat panel that is preferably substantially rectangular in shape. The bottom panel 30 comprises a first surface 31, a first end 32, a second surface 33 opposite of the first surface 31, second end 34 opposite of the first end 32, a first side edge 36, and a second side edge 38 opposite of the first side edge 36. The first surface 31 faces the interior space 12 of the case 10 and comprises an interior surface of each of the compartments 20 of the case 10. The second surface 33 faces the exterior of the case 10 and comprises a portion of the exterior surface 14 of the case 10.

The bottom panel 30 comprises a longitudinal axis that extends between the first end 32 and the second end 34. The first side edge 36 and the second side edge 38 preferably extend substantially parallel with each other and with the longitudinal axis between the first end 32 and the second end 34. In this example embodiment, the first side edge 36 corresponds with the first side of the case 10 and the second side edge 38 corresponds with the second side of the case 10 that is opposite of the first side of the case 10. The distance between the first end 32 and the second end 34 of the bottom panel 30 corresponds to the length dimension of the case 10 in this example embodiment. The distance between the first side edge 36 and the second side edge 38 of the bottom panel 30 corresponds to the width dimension of the case 10 in this example embodiment.

2. First and Second Divider Panels.

The first divider panel 50 comprises an elongated, substantially planar panel that is preferably substantially rectangular in shape. The first divider panel 50 extends upwardly from the first surface 31 of the bottom panel 30 preferably at an angle that is substantially perpendicular to the plane of the bottom panel 30. The first divider panel 50 also extends longitudinally substantially along the longitudinal axis of the bottom panel 30 substantially between the first end 32 and the second end 34 of the bottom panel 30. The first divider panel 50 comprises and may also be referred to as a center divider of the case 10 in that it extends longitudinally along the longitudinal axis of the bottom panel 30 substantially centered between and substantially equidistant from the first side edge 36 and the second side edge 38 of the bottom panel 30.

The first divider panel 50 comprises a first surface 52 that faces generally in the direction of the first side edge 36 of the bottom panel 30 and a second surface 55 that is opposite the first surface 52 and that faces generally in the direction of the second side edge 38 of the bottom panel 30. The first surface 52 thus substantially faces the first side of the case 10 and comprises an interior surface of the two longitudinally adjacent compartments 20 on the first side of the case 10, and the second surface 54 substantially faces the second side of the case 10 and comprises an interior surface of the two longitudinally adjacent compartments 20 on the second side of the case 10.

The first divider panel 50 also comprises a top portion 56. The vertical distance between the top of the top portion 56 and the bottom panel 30 corresponds to the height dimension of the case 10 in this example embodiment.

The first divider panel 50 may be formed integrally with the bottom panel 30 or may comprise a separate structure that is attached or connected to the bottom panel 30. The first divider panel 50 may be attached or connected to the bottom panel 30 using any suitable means, including for example an adhesive or a hardware fastener.

The second divider panel 60 comprises a substantially planar panel that is preferably substantially triangular in shape. The second divider panel 60 has a bottom portion 62 that corresponds to the base of the triangle, a top portion 64 that corresponds to the apex of the triangle, a first side edge 65 that corresponds to one side of the triangle, and a second side edge 66 that corresponds to the second side of the triangle.

The second divider panel 60 extends upwardly from the first surface 31 of the bottom panel 30 with the bottom portion 62 on the bottom panel 30 and the top portion 64 corresponding to the apex of the triangle elevated above the bottom panel 30. Preferably, the second divider panel 60 extends upwardly from the bottom panel 30 at an angle that is substantially perpendicular to the plane of the bottom panel 30.

The second divider panel 60 also extends substantially transversely across and through the first divider panel 50 substantially between the first side edge 36 of the bottom panel 30 and the second side edge 38 of the bottom panel 30, with the first side edge 65 of the second divider panel 60 extending at a first slope or angle from the first side edge 36 of the bottom panel 30 to the top portion 64 of the second divider panel 60, i.e., the apex of the triangle, and the second side edge 66 of the second divider panel 60 extending at a second slope or angle from the second side edge 38 of the bottom panel 30 to the top portion 64 of the second divider panel 60, i.e., the apex of the triangle. Preferably, the first and second slopes or angles are substantially the same. The second divider panel 60 comprises and may also be referred to as a transverse divider of the case 10 in that it extends substantially transverse to the longitudinal axis of the bottom panel 30 and the plane of the first divider 50 substantially centered between and substantially equidistant from the first end 32 and the second end 34 of the bottom panel 30.

The second divider panel 60 comprises a first surface 67 that faces generally in the direction of the first end 32 of the bottom panel 30 and a second surface 68 that is opposite the first surface 67 and that faces generally in the direction of the second end 34 of the bottom panel 30. The first surface 67 thus substantially faces the first end of the case 10 and comprises an interior surface of the two compartments 20 that are on the first end of the case 10 and on opposite sides of the first divider panel 50 and the case 10. Similarly, the second surface 68 substantially faces the second end of the case 10 and comprises an interior surface of the two compartments 20 that are on second end of the case 10 and on opposite sides of the first divider panel 50 and the case 10. Additionally, the portions of the first and second surfaces 67, 68 that are adjacent to the first side surface 52 of the first divider 50 comprise interior surfaces of the two compartments 20 that are longitudinally adjacent along the first surface 52 of the first divider 50 and the first side of the case 10, and the portions of the first and second surfaces 67, 68 that are adjacent to the second side surface 54 of the first divider 50 comprise interior surfaces of the two compartments 20 that are longitudinally adjacent along the second side surface 54 of the first divider 50 and the second side of the case 10.

The vertical distance between the top of the top portion 64 of the second divider 60 and the bottom panel 30 is preferably substantially the same or slightly greater than the vertical distance between the top of the top portion 56 of the first divider 50 and the bottom panel 30. Thus, the distance between the top of the top portion 64 of the second divider 60 and the bottom panel 30 corresponds to the height dimension of the case 10 in this example embodiment.

The second divider panel 60 may be formed integrally with the first divider panel 50 and/or with the bottom panel 30 or may comprise a separate structure that is attached or connected to the first divider panel 50 and the bottom panel 30 using suitable means, including for example an adhesive or a hardware fastener. A transverse slot may be provided in the first divider panel 50 and the second divider panel 60 may extend substantially transversely across the first divider panel 50 through the slot. Alternatively, the second divider panel 60 can be constructed of two separate mirror-image triangle-shaped panels with the two panels extending transversely from the opposite first and second side surfaces 52, 54 respectively of the first divider panel 50 to the opposite first and second side edges 36, 38 of the bottom panel 30.

3. First and Second End Panels.

The first end panel 70 and the second end panel 80 each comprise a substantially planar triangle-shape panel that is preferably substantially identical to the second divider panel 60. The first end panel 70 and the second end panel 80 each have a bottom portion 72, 82 respectively that corresponds to the base of the triangle, a top portion 74, 84 respectively that corresponds to the apex of the triangle, a first side edge 75, 85 respectively that corresponds to one side of the triangle, and a second side edge 76, 86 respectively that corresponds to the second side of the triangle.

The first end panel 70 extends upwardly from the first surface 31 of the bottom panel 30 with the bottom portion 72 being on the bottom panel 30 at or near the first end 32 and the top portion 74 corresponding to the apex of the triangle elevated above the bottom panel 30. Similarly, the second end panel 80 extends upwardly from the first surface 31 of the bottom panel 30 with the bottom portion 82 being on the bottom panel 30 at or near the second end 34 and the top portion 84 corresponding to the apex of the triangle elevated above the bottom panel 30. Preferably, both of the first and second end panels 70, 80 extend upwardly from the bottom panel 30 at an angle that is substantially perpendicular to the plane of the bottom panel 30.

The first and second end panels 70, 80 also extend transversely to the longitudinal axis of the bottom panel 30 past or through the first divider panel 50 substantially between the first side edge 36 of the bottom panel 30 and the second side edge 38 of the bottom panel 30. The respective first side edges 75, 85 of the first and second end panels 70, 80 extend at a first slope or angle from the first side edge 36 of the bottom panel 30 to their respective top portion 74, 84, i.e., the apexes of the triangles. The respective second side edges 76, 86 of the first and second end panels 70, 80 extend at a second slope or angle from the second side edge 38 of the bottom panel 30 to their respective top portions 74, 84, i.e., the apexes of the triangles. Preferably, the first and second slopes or angles are substantially the same.

The first end panel 70 and the second end panel 80 each comprise a first surface 77, 87 respectively that faces generally in the direction of the second divider panel 60, i.e., toward the interior space 12 of the case 10. The first surface 77 of the first end panel 70 comprises an interior surface of the two compartments 20 that are on the first end of the case 10 on the first and second side surfaces 52, 54 respectively of the first divider panel 50, i.e., directly across from each other on opposite sides of the first end of the case 10. Similarly, the first surface 87 of the second end panel 80 comprises an interior surface of the two compartments 20 that are on second end of the case 10 on the first and second side surfaces 52, 54 respectively of the first divider panel 50, i.e., directly across from each other on opposite sides of the second end of the case 10. The first end panel 70 and the second end panel 80 each also comprise a second surface 79, 89 respectively that faces the exterior of the case 10 and comprises a portion of the exterior surface 14 of the case 10.

The vertical distance between the tops of the respective top portions 74, 84 of the first and second end panels 70, 80 and the bottom panel 30 is preferably substantially the same as the vertical distance between the top of the top portion 64 the second divider panel 60 and the bottom panel 30. Thus, the vertical distance between the tops of the respective top portions 74, 84 and the bottom panel 30 corresponds to the height dimension of the case 10 in this example embodiment.

Either or both of the first and second end panels 70, 80 may be formed integrally with the bottom panel 30 and/or the first divider panel 50 or may comprise separate structures that are attached or connected to the bottom panel 30 and/or the first divider panel 50 using suitable means, including for example adhesives or hardware fasteners. If desired, transverse slots may be provided in the first divider panel 50 at or near the first and second ends 32, 34 respectively of the bottom panel 30 and the first and second end panels 70, 80 may extend substantially transversely across the first divider panel 50 through the slots. Alternatively, if desired either or both of the first and second end panels 70, 80 can be constructed of two separate mirror-image triangle-shaped panels with the two panels extending transversely from the opposite first and second side surfaces 52, 54 respectively of the first divider panel 50 to the opposite first and second side edges 36, 38 at or near the first and second ends 32, 34 of the bottom panel 30.

4. Door Panels.

Each of the plurality of compartments 20 has a corresponding door panel 40. Each of the plurality of door panels 40 is preferably substantially the same, except as specifically described further below. Each door panel 40 comprises a substantially planar panel that is preferably substantially rectangular in shape. Each door panel 40 comprises a first end 41, a second end 42 opposite of the first end 41, a top portion 43 with a top edge, and a bottom portion 44 with a bottom edge opposite of the top portion 43. Each door panel 40 also comprises a longitudinal axis that extends between the first end 41 and the second end 42. The edge of the top portion 43 and the edge of the bottom portion 44 preferably extend substantially parallel with each other and with the longitudinal axis between the first end 41 and the second end 42.

Each door panel 40 also comprises a first surface 45 and a second surface 46 that is opposite of the first surface 45. Each door panel 40 has an open state or position and a closed state or position. When the door panel 40 is in the closed state, the first surface 45 provides an interior surface of an individual compartment 20 and the second surface 46 provides a portion of the exterior surface of the case 10 that corresponds to the same individual compartment 20.

Each door panel 40 is configured and dimensioned to provide complete enclosure of the portion of the interior space 12 of the case 10 comprising an individual compartment 20 when the door panel 40 is in the closed state. Thus, in this example embodiment of a substantially triangle-shape case 10 with two longitudinally adjacent compartments 20 on each side of the first divider 50, each door panel 40 will have a length dimension that is about half the length of the first divider 50 and the bottom panel 30, and a width dimension that is about the same as the first and second side edges 65, 66, 75, 76, 85, 86 of the second divider 60, first end panel 70, and second end panel 80 respectively.

Figure 2:
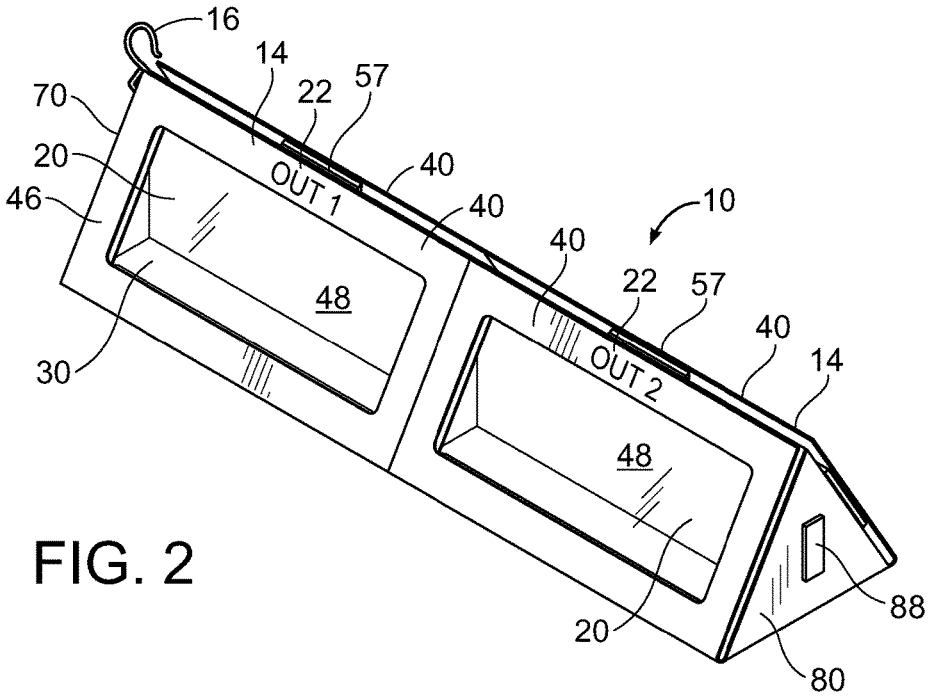
FIG. 2 is a perspective view of an airplane tray cover multi-compartment holder system and method in accordance with an example embodiment illustrated with door panels of a multi-compartment case in a closed state.
Figure 3:
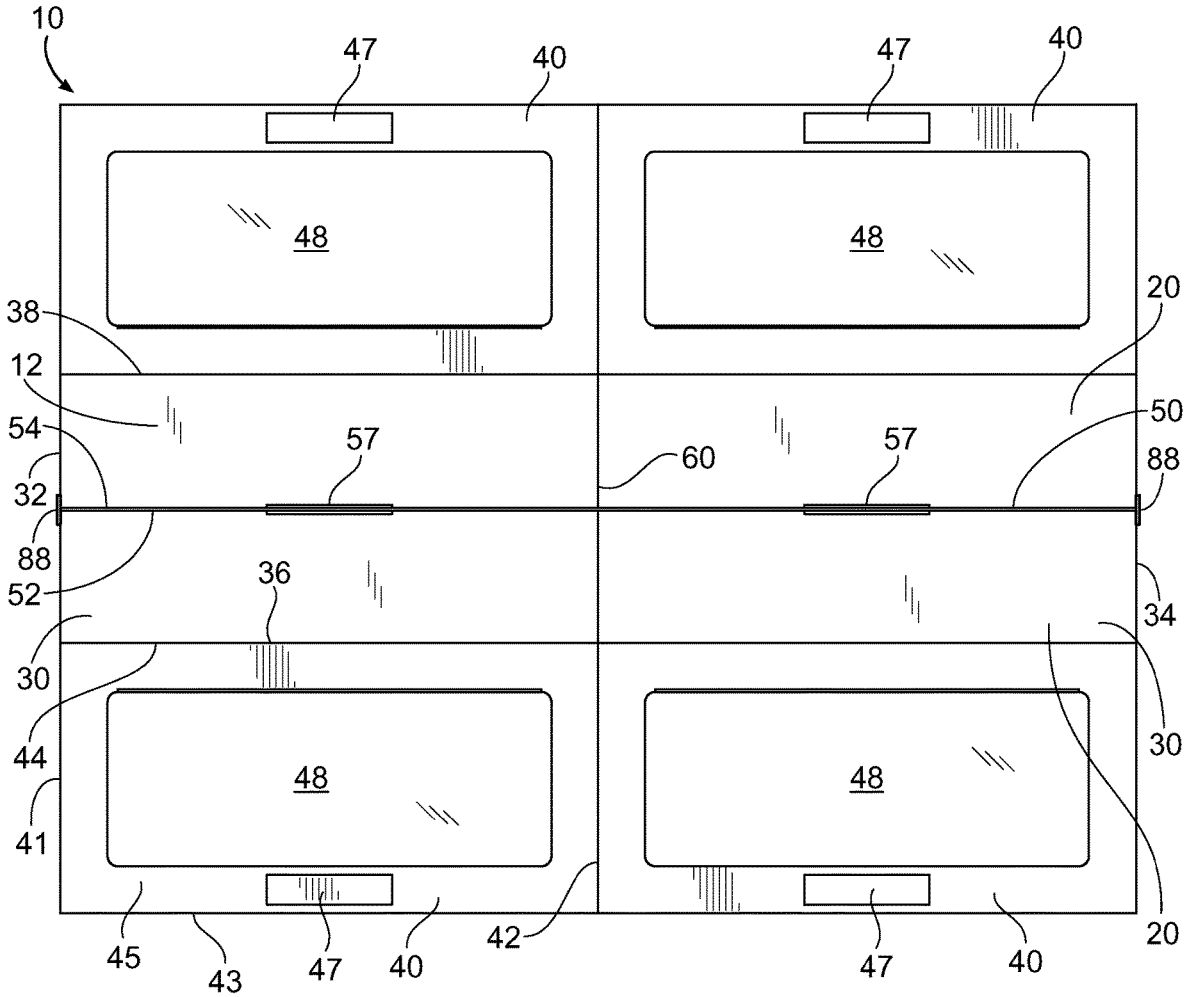
FIG. 3 is a top view of an airplane tray cover multi-compartment holder system and method open in accordance with an example embodiment illustrated with door panels of a multi-compartment case in an open state.
Figure 4:
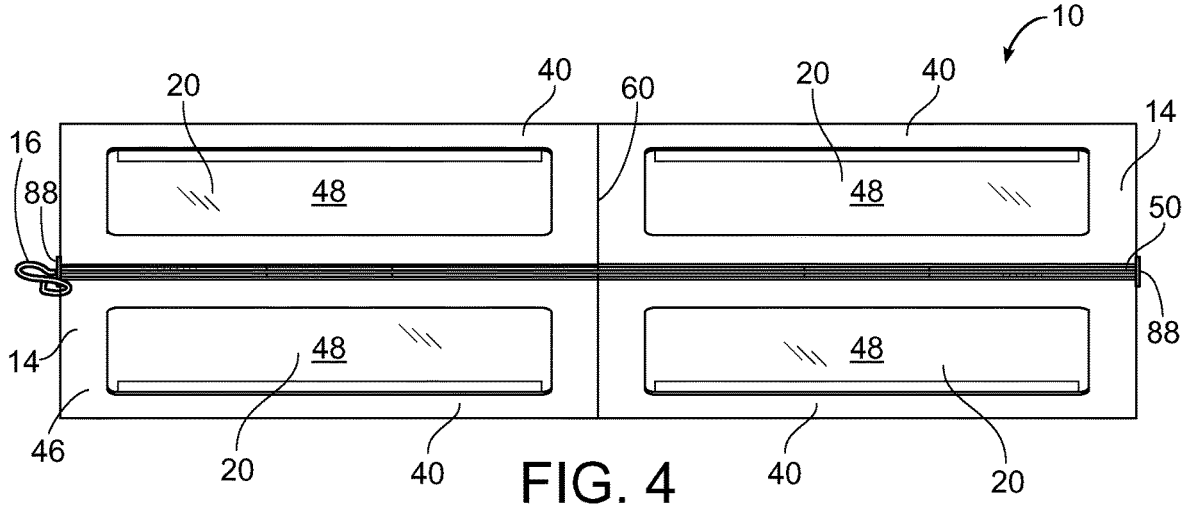
FIG. 4 is a top view of an airplane tray cover multi-compartment holder system and method in accordance with an example embodiment illustrated with door panels of a multi-compartment case in a closed state.
Figure 5:
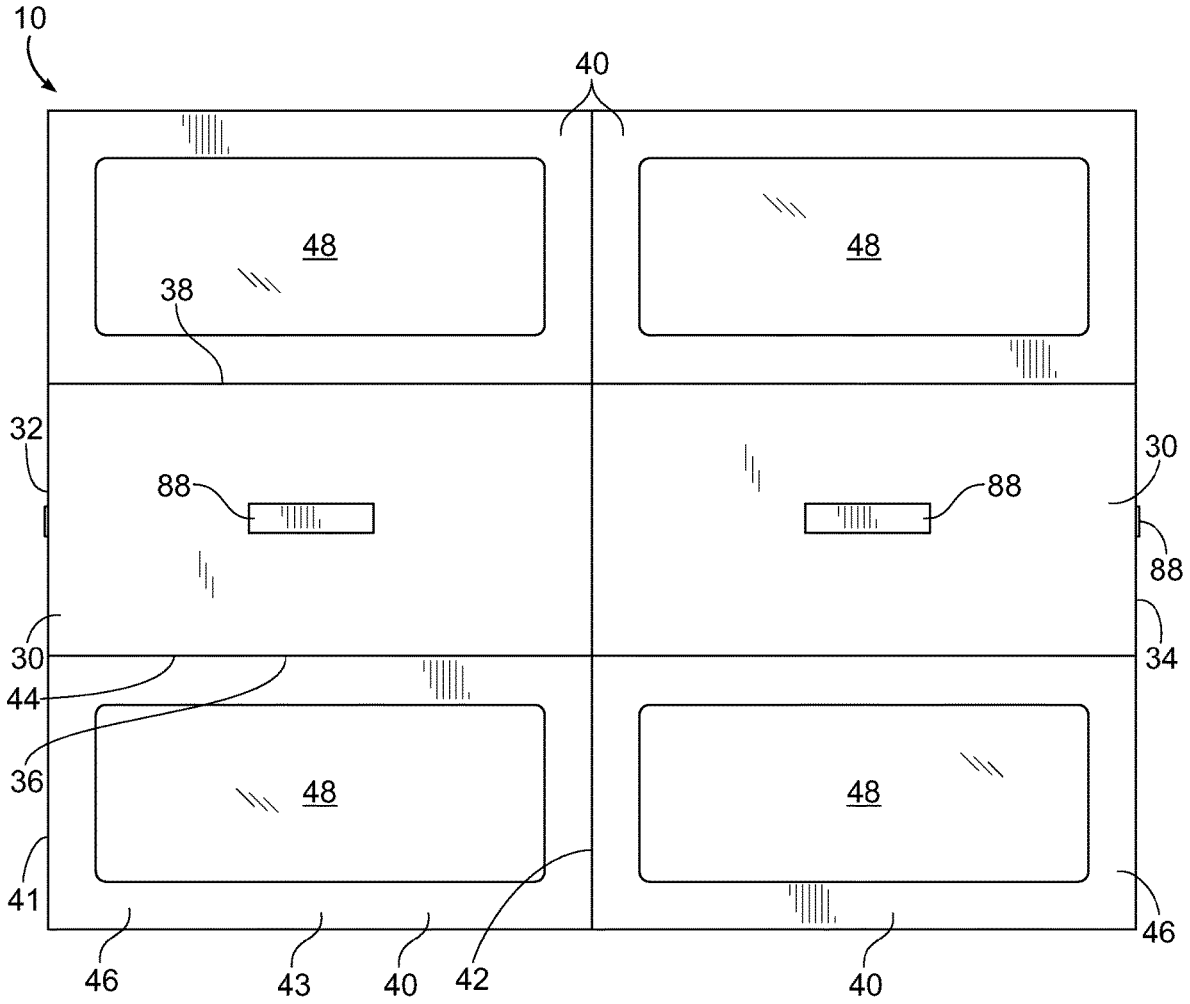
FIG. 5 is a bottom view of an airplane tray cover multi-compartment holder system and method in accordance with an example embodiment illustrated with door panels of a multi-compartment case in an open state.
Figure 6:
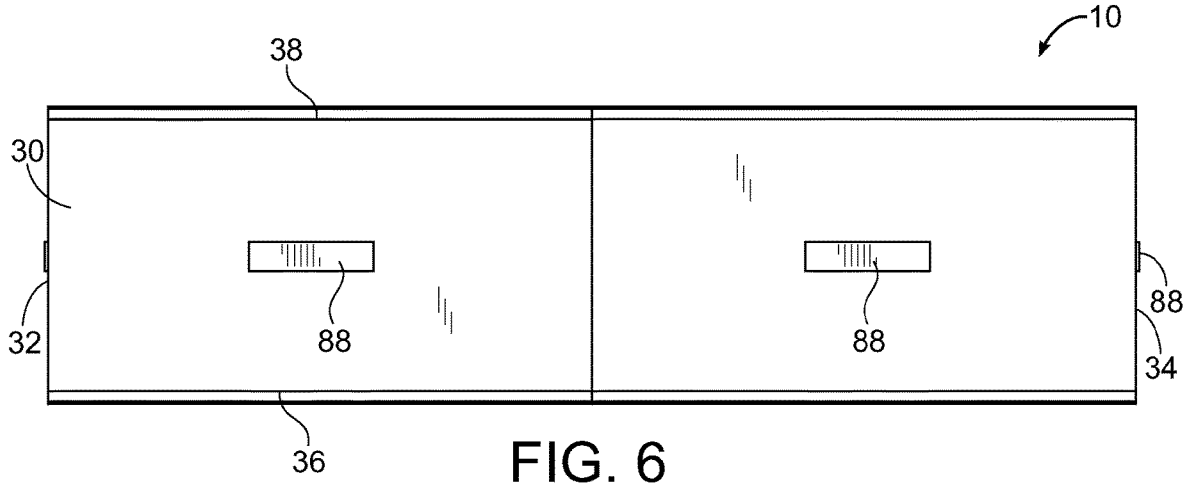
FIG. 6 is a bottom view of an airplane tray cover multi-compartment holder system and method in accordance with an example embodiment illustrated with door panels of a multi-compartment case in a closed state.
Figure 7:
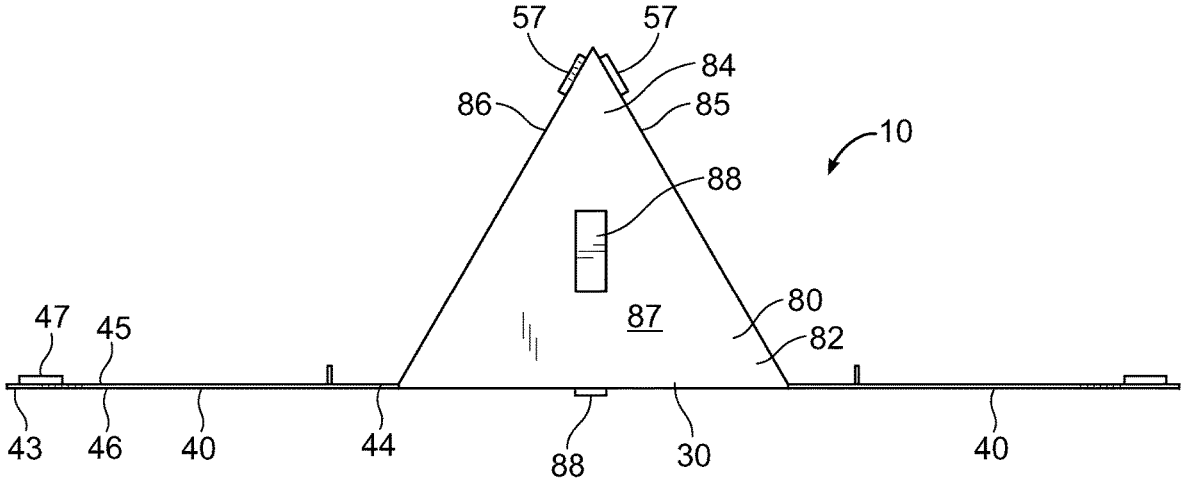
FIG. 7 is an end view of an airplane tray cover multi-compartment holder system and method in accordance with an example embodiment illustrated with door panels of a multi-compartment case in an open state.
Figure 8:
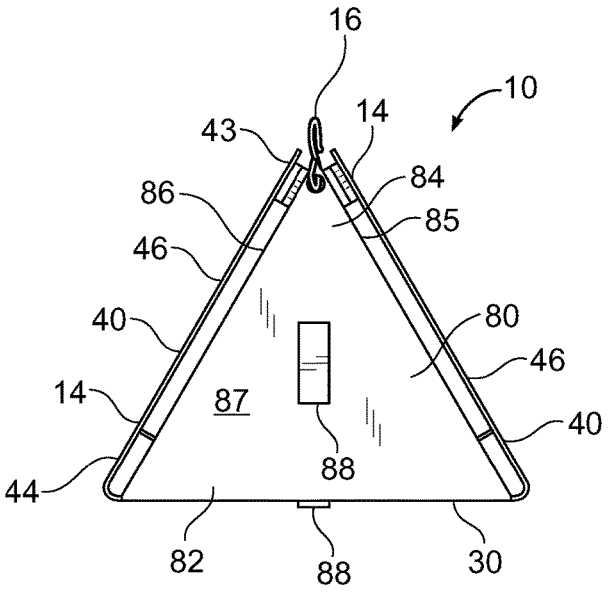
FIG. 8 is an end view of an airplane tray cover multi-compartment holder system and method in accordance with an example embodiment illustrated with door panels of a multi-compartment case in a closed state.
Figure 9:
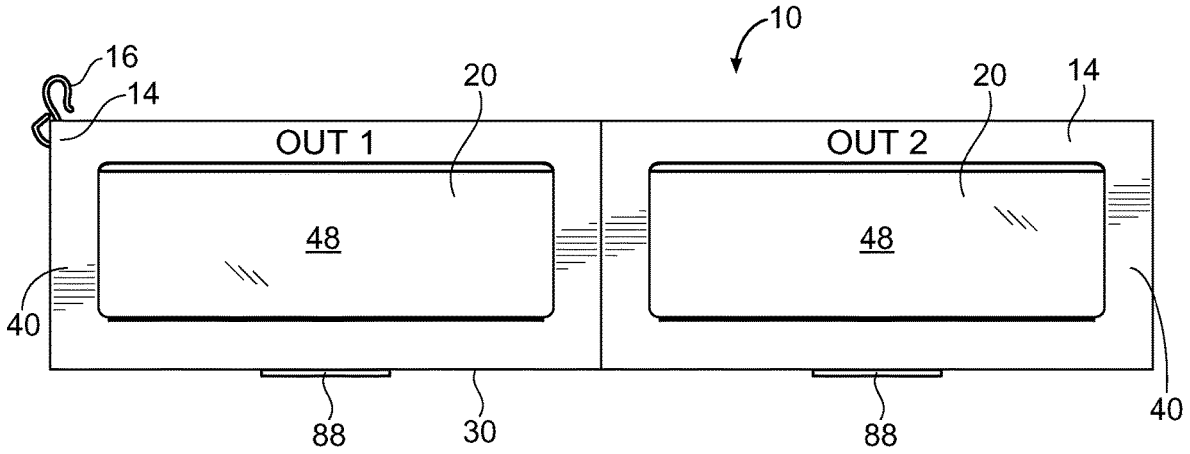
FIG. 9 is a side view of an airplane tray cover multi-compartment holder system and method in accordance with an example embodiment illustrated with door panels of a multi-compartment case in a closed state.
Figure 10:
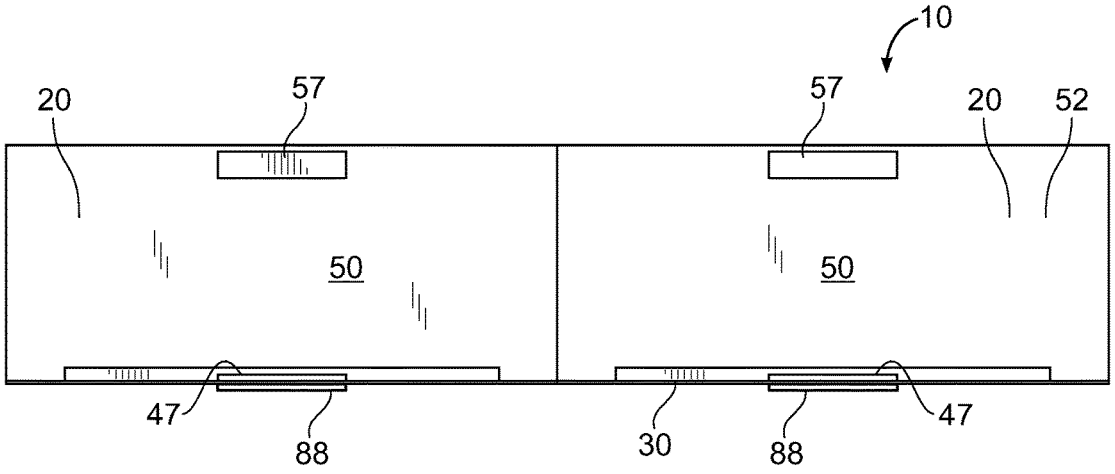
FIG. 10 is a side view of an airplane tray cover multi-compartment holder system and method in accordance with an example embodiment illustrated with door panels of a multi-compartment case in an open state.
Figure 15:
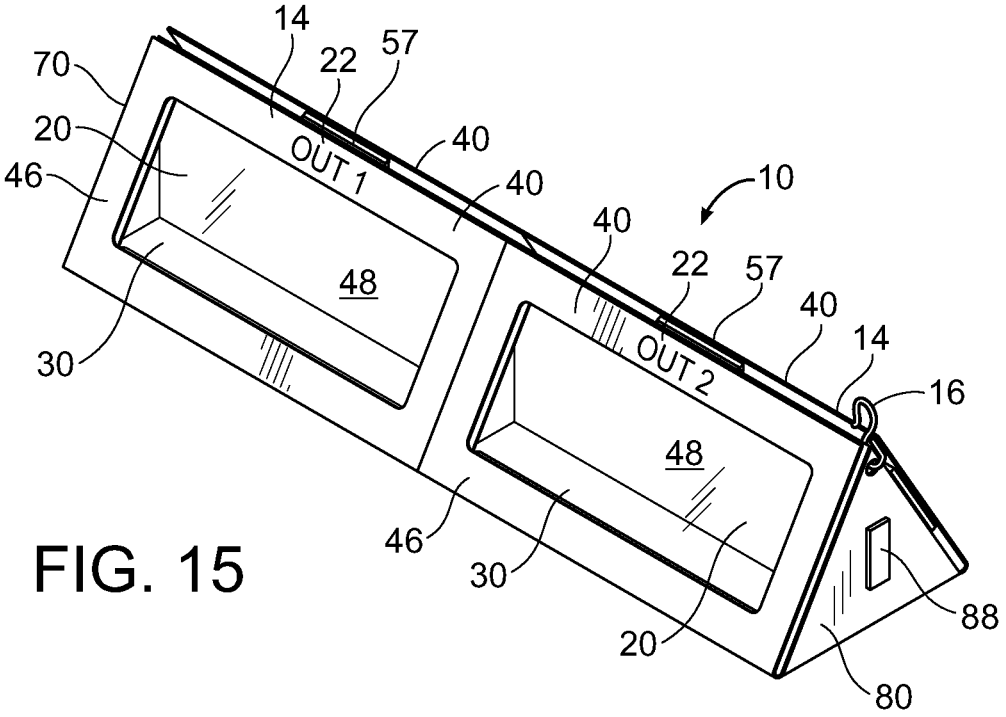
FIG. 15 is a top perspective view of an airplane tray cover multi-compartment holder system and method in accordance with an example embodiment illustrated in a complete constructed state with door panels folded in place.
Figure 19:
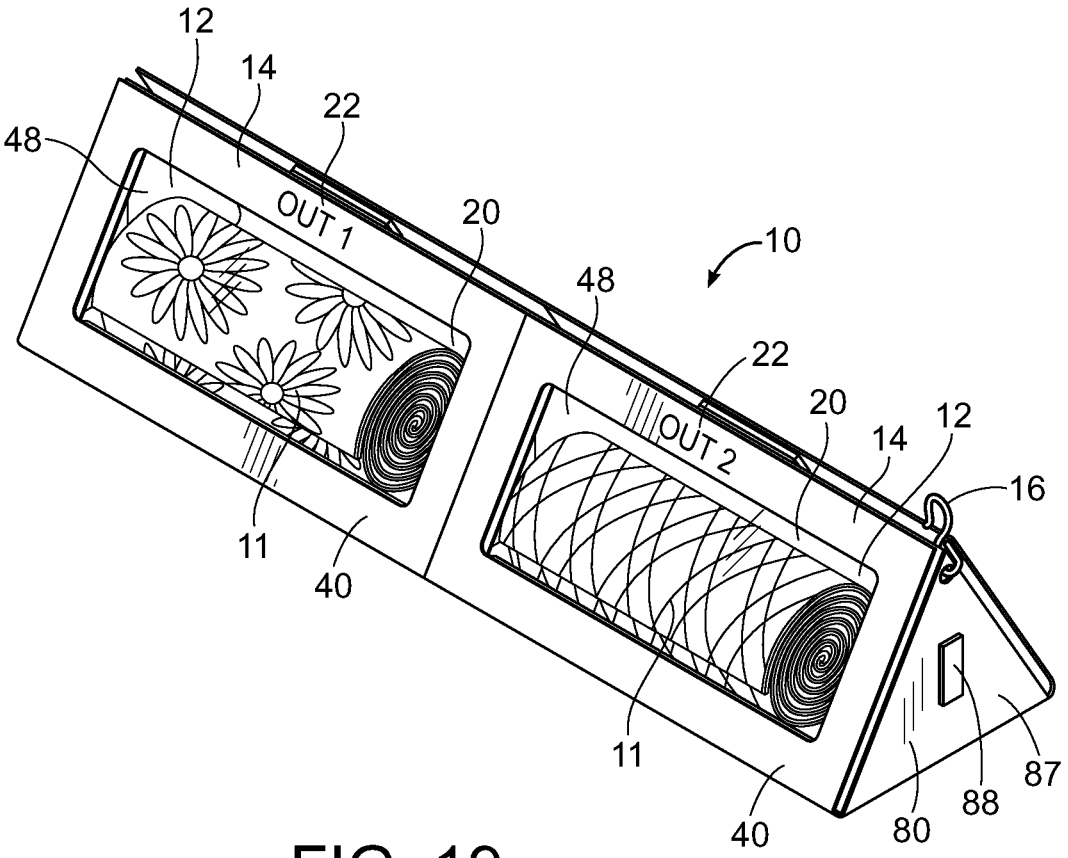
FIG. 19 is a perspective view of an airplane tray cover multi-compartment holder system and method in accordance with an example embodiment illustrating individual tray covers with unique indicia visible in individual compartments of a multi-compartment case.

With the door panels 40 in the closed state, as best illustrated in FIGS. 2, 15, and 19 each individual compartment 20 of the case 10 comprises a space that is defined by a portion of the interior surface of the bottom panel 30, a portion of the interior surface of each of the first divider panel 50 and the second divider panel 60, a portion of the interior surface of one of the first and second end panels 70, 80, and the interior surface of the door panel 40. The space corresponding to each individual compartment 20 is thus separate and isolated from the spaces corresponding to each of the other compartments 20 comprising the case 10 and potential cross-contamination between covers or other items in each of the compartments 20 is avoided.

Figure 16:
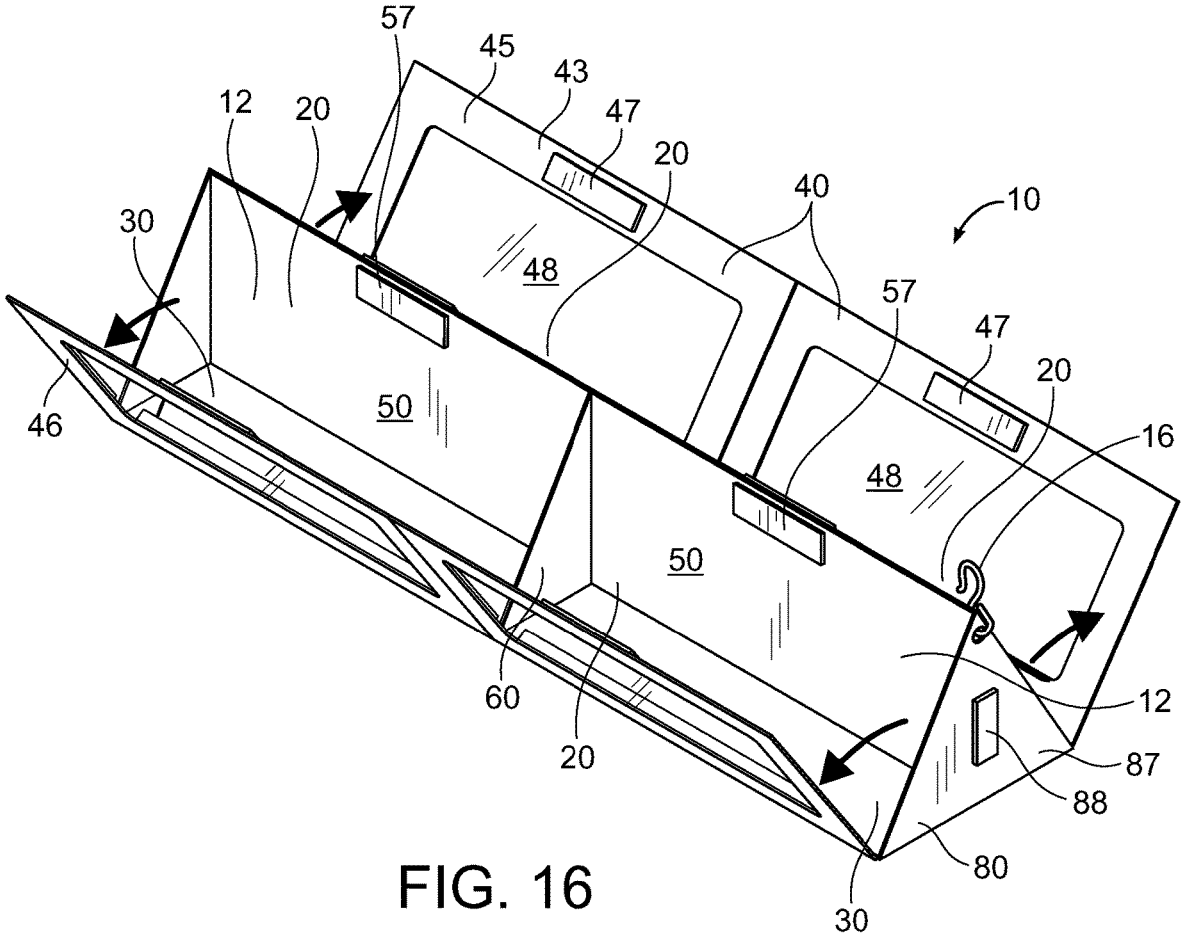
FIG. 16 is a perspective view of an airplane tray cover multi-compartment holder system and method in accordance with an example embodiment illustrating door panels of a multi-compartment case being pivoted from a closed state to an open state.
Figure 18:
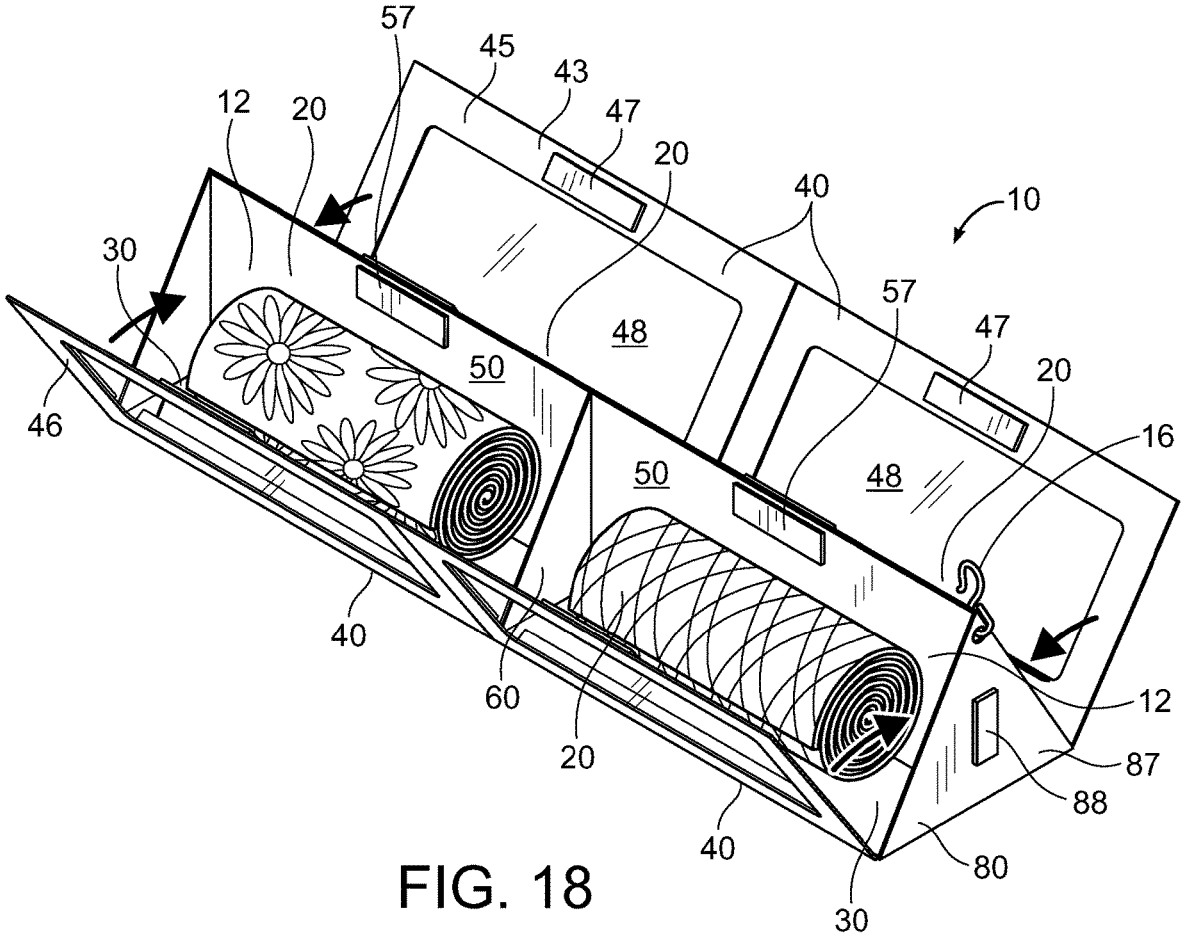
FIG. 18 is a perspective view of an airplane tray cover multi-compartment holder system and method in accordance with an example embodiment illustrating door panels of a multi-compartment case being pivoted from an open state to a closed state.

Each door panel 40 is separately movably connected or attached to the case 10 so that each door panel 40 is separately and selectively movable between the open state and the closed state as illustrated in FIGS. 16 and 18. Preferably, each door panel 40 is separately pivotably connected or attached to the case 10 and is separately and selectively pivotable between the open and closed state. More specifically, each door panel 40 is pivotably connected or attached at or near the bottom edge of its bottom portion 44 to the bottom panel 30 at or near the first side edge 36 or the second side edge 38 of the bottom panel 30. Preferably the pivotable connection will have an axis of rotation that is substantially parallel with the longitudinal axis of the bottom panel 30.

Figure 17:
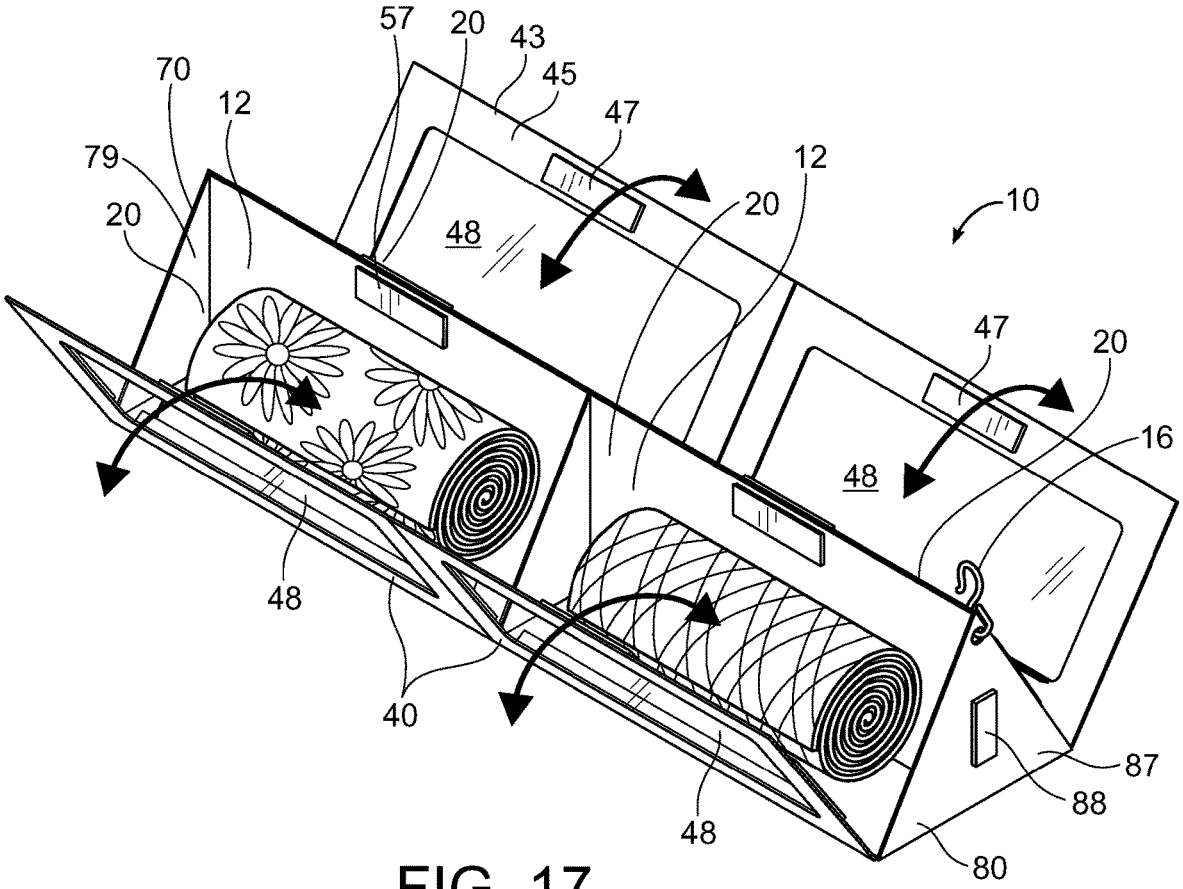
FIG. 17 is a perspective view of an airplane tray cover multi-compartment holder system and method in accordance with an example embodiment illustrating the insertion and retrieval of individual tray covers from individual open compartments of a multi-compartment case.

With a door compartment 40 in the open state, a tray cover or other item can be placed in a corresponding individual compartment 20 or accessed or retrieved from the compartment 20 as illustrated in FIG. 17. With the door compartment 40 in the closed state, a tray cover or other item in a corresponding compartment 20 is held separate and isolated from the tray covers or other items in the other compartments 20 for storage or transportation as illustrated in FIG. 19. The indicia 11 described above that uniquely identifies each compartment 20 may be present on the door panel 40 corresponding to the compartment 20 to aid users in selecting fresh, unused covers or other items and in returning used trays or other items to the appropriate compartments 20 from which they were retrieved to avoid cross-contamination. Alternatively or in addition, the indicia 11 may be present on one or more of the surfaces of the bottom panel 30, first divider panel 50, second divider panel 60, first end panel 70, and second end panel 80 that define each compartment 20.

The door panels 40 may be formed integrally with the bottom panel 30 or may comprise separate structures that are connected or attached to the bottom panel 30. When the door panels 40 are formed integrally with the bottom panel 30, a crease or fold may be formed between the bottom edge of the bottom portion 44 of each door panel 40 and the first side edge 36 or the second side edge 38 of the bottom panel 30. The crease or fold functions as a hinge-type of pivotable connection between the bottom portion 44 of the door panel 40 and the first side edge 36 or the second side edge 38 of the bottom panel 30. The hinge-type pivotable connection enables the door panels 40 to pivot or rotate upward and downward relative to the bottom panel 30 between the open state and the closed state as illustrated in FIGS. 16 and 18. Alternatively, when the door panels 40 comprise separate structures from the bottom panel 30, other forms of pivotable connections can be used including various types of hinges, rotating axles, etc.

Each door panel 40 comprises a connector 47 that is adapted to releasably hold the door panel 40 in the closed state or position in relation to the case 10. The case 10 preferably will include a plurality of corresponding connectors 57 with each corresponding connector 57 being positioned to be in alignment with a connector 47 of an individual door panel 40 when the door panel 40 is in the closed state or position. The connectors 47 and corresponding connectors 57 are configured and adapted to be selectively manipulated by a user of the case 10 to hold each of the door panels 40 in the closed position when the user moves them to that position and to release each of the door panels 47 when the user wishes to move them to the open position. Any types of connectors suitable for these purposes may be used including magnets, snaps, Velcro® strips, etc.

Preferably, the connector 47 on each door panel 40 is positioned at or near the top edge of the top portion 43 of the door panel 40. If necessary or desired to better align connector 47 with a corresponding connector 57, the top portion 43 may be folded inwardly toward the case 10 to form a flap and the connector 47 may be attached or connected to a portion of the folded flap that faces toward the case 10. The corresponding connectors 57 may be connected or attached to the case 10 in any manner suitable to align the connectors 57 with the corresponding connectors 47 of the door panels 40. In one preferred arrangement, the connectors 57 are connected or attached to the first divider panel 50 of the case 10 and are positioned on the first surface 52 and the second surface 54 of the first divider panel 50 at or near the top portion 56 so that each corresponding connector 57 is aligned with a connector 47 on a door panel 40. Again, if necessary or desired, a connector 57 may be connected or attached to a flap, extension, or other structure on the first divider panel 50 to better align the connector 57 with the corresponding connector 47 on the door panel 40. The connectors 47 and corresponding connectors 57 thus releasably hold each door panel 40 to the case 10 and more particularly to the first divider panel 50 with the top portion 43 of the door panel 40 adjacent to the top portion 56 of the first divider panel 50 when the door panel 40 is in the closed state. The connectors 47 and 57 may be connected or attached to the door panels 40 and to the first divider panel 50 respectively using any suitable means, including an adhesive or a hardware fastener for example.

Each door panel 40 preferably comprises a window element 48 as described above. The window element 48 enables a user to view the interior of individual compartment 20 to which the door panel 40 corresponds, as well as the contents therein, without the need to first move the door panel 40 to the open state. As described above, the user may thus determine if a compartment 20 contains a tray cover or other item, and may select a particular cover or item to access based on the indicia 11 or otherwise without first opening the corresponding door panel 40 and potentially exposing the tray cover or item to the environment. The user may also determine if a compartment 20 is empty before placing a tray cover or other item in the compartment 20.

As described above, the window element 48 may be formed as an integral part of the door panel 40 or may comprise a separate structure from the door panel 40 and may be connected or attached over an opening in the door panel 40 using any suitable adhesive, mechanical fasteners or other suitable means. Alternatively or in addition, one or more of the other panels defining the individual compartments 20 and exposed to the exterior of the case 10, i.e., the bottom panel 30 and the first and second end panels 70, 80, may comprise a window element. Similarly to a window element 48 of a door panel 40, window elements in these panels would enable users to view the interior of each individual compartment 20 and the individual cover or item therein for the same purposes as described above without first opening a corresponding door panel 40.

Another beneficial feature of the door panel 40 that is also applicable to the door panels 40 of all of the example embodiments described herein is that each door panel 40 preferably comprises a support structure such as an elongated ridge or the like formed on the first (interior-facing) surface 45. The support structure is configured and adapted to engage and retain a portable electronic device such as a smart phone in a viewable position, e.g., angled upward on its side or end with the back of the device resting against the case 10, for viewing by a user when the door panel 40 is in the open position.

5. Alternative Configurations and Multi-Case Structures.

It will be appreciated from the foregoing descriptions that this example embodiment of the case 10 has a substantially triangle- or prism-shape exterior profile and triangle-shape cross-section with an interior space 12 that is divided into four substantially triangle-shape compartments 20 each having substantially the same shape and substantially the same volume. Further, it will be appreciated that the bottom panel 30 corresponds to the base of the triangle, the height dimensions of the first divider panel 50, the second divider panel 60, and the first and second end panels 70, 80 correspond to the height dimension of the triangle, and the door panels 40, the first and second side edges 65, 66 of the second divider panel 60, and the first and second side edges of the 75, 76, 85, 86 of the first and second end panels 70, 80 correspond to the sides of the triangle. It will further be appreciated that the compartments 20 are arranged so that two compartments 20 are longitudinally adjacent on each opposing side of a center divider panel 50 of the case 10 and each compartment 20 on one side of the case 10 is directly opposite a compartment 20 on the opposite side of the case 10.

However, it is contemplated and will also be appreciated that the case 10 as well as each of the compartments 20 therein may be constructed to have other cross-sectional shapes, including for example, round, half-round, quadrangle, or other polygon shapes. In addition, the number of compartments 20 in the case 10 need not be limited to four and the compartments 20 need not be of substantially the same volume. For example, the second divider panel 60 could be removed to form a case 10 with two compartments 20. Alternatively, one or more additional second divider panels 60 could be used to form a case with six, eight, or more compartments 20. Moreover, one or more second divider panels 60 could be spaced along the longitudinal axis of the bottom panel 30 within the interior space 12 so as to create compartments 20 having different volumes.

Further, one or more and preferably all of the bottom panel 30, the first end panel 70, and the second end panel 80 may be provided with connectors 88 of the same types as the connectors 47, 57 described previously. The connectors 88 make the example multi-compartment case 10 described above modular and enable a user to selectively and releasably connect multiple such cases 10 together either end-to-end, bottom-to-bottom or both to form a variety of combined- or multi-case structures.

Figure 20:
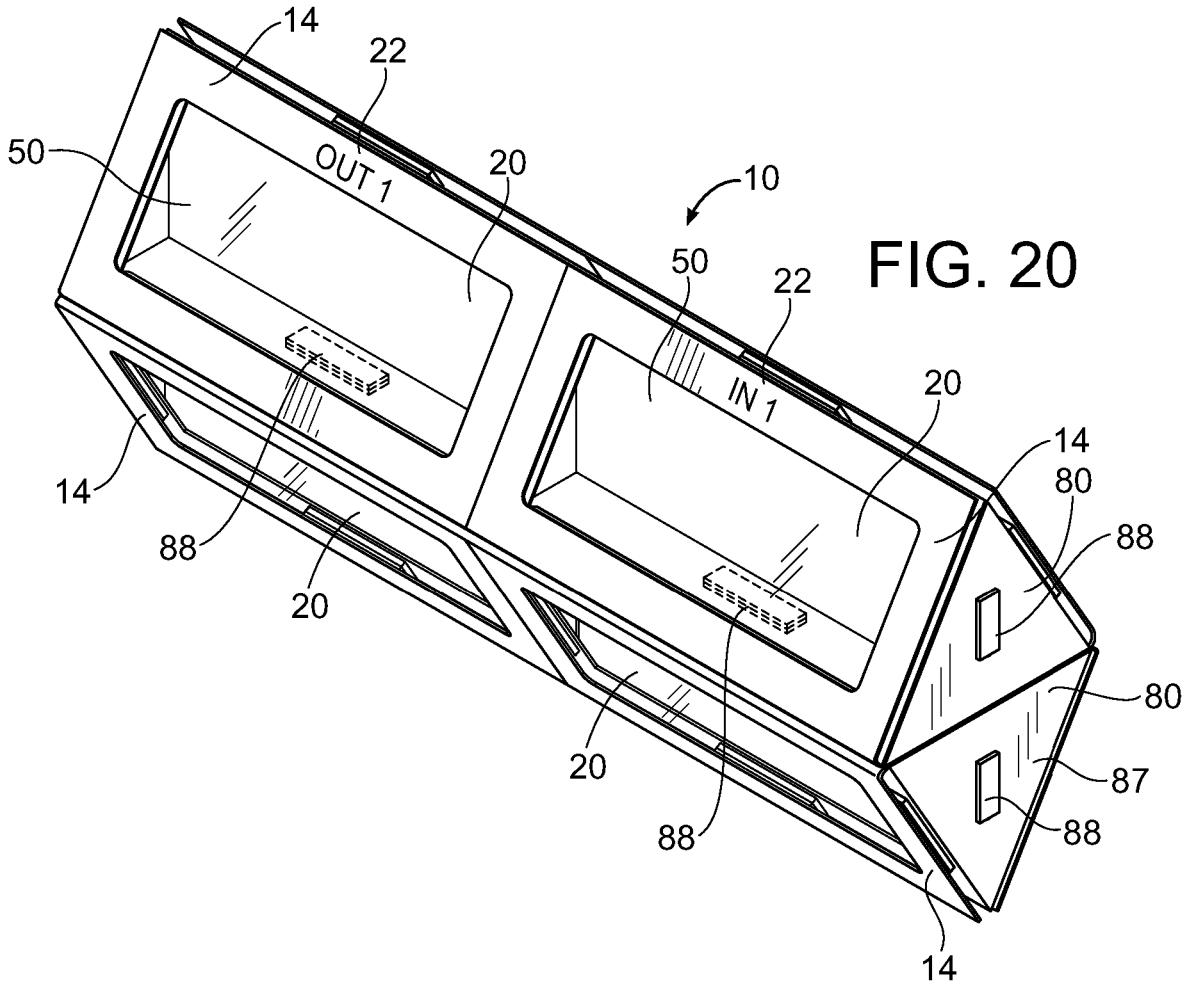
FIG. 20 is a perspective view of an airplane tray cover multi-compartment holder system and method in accordance with an alternative example embodiment illustrating two four-compartment cases connected together as a multi-case structure.

For example, as illustrated in FIG. 20 two individual substantially triangle-shape multi-compartment cases 10 as described above can be releasably connected bottom-to-bottom via corresponding connectors 88 on the second (exterior) surfaces 33 of their respective bottom panels 30 to form a modular combined- or multi-case structure with eight individual compartments 20 and a substantially quadrangle-shape external profile and cross-section. The particular quadrangle-shape formed depends on the relative dimensions of the panels of the individual cases 10 that correspond to the base and sides of the triangle. For example, two such cases 10 having isosceles triangle shapes connected bottom-to-bottom result in a substantially diamond-shape combined- or multi-case structure, whereas two such cases 10 having equilateral triangle shapes connected bottom-to-bottom result in a substantially square-shape combined- or multi-case structure.

Similarly, two or more substantially triangle-shape multi-compartment cases 10 as described above can be releasably connected end-to-end via connectors 88 on the respective second (exterior) surfaces 79, 89 of their respective end panels 70, 80 to form an elongated modular combined- or multi-case structure with eight individual compartments having the same substantially triangle-shape exterior profile and cross-section as each of the individual cases 10. By further connecting each of the individual cases 10 in a bottom-to-bottom fashion with two additional individual cases 10 as described above a four-case elongated combined- or multi-case structure with sixteen individual compartments and a substantially diamond- or square-shape profile and cross-section can be formed.

6. Example Construction of the Multi-Compartment Case.

This example embodiment of the case 10 can be constructed in a number of different ways. One way is to separately form the bottom panel 30, the door panels 40, the first divider panel 50, the second divider panel 60, the first end panel 70, and the second end panel 80 and then assemble them together as described herein using suitable adhesive and/or mechanical fasteners to form the case 10.

Figure 11:
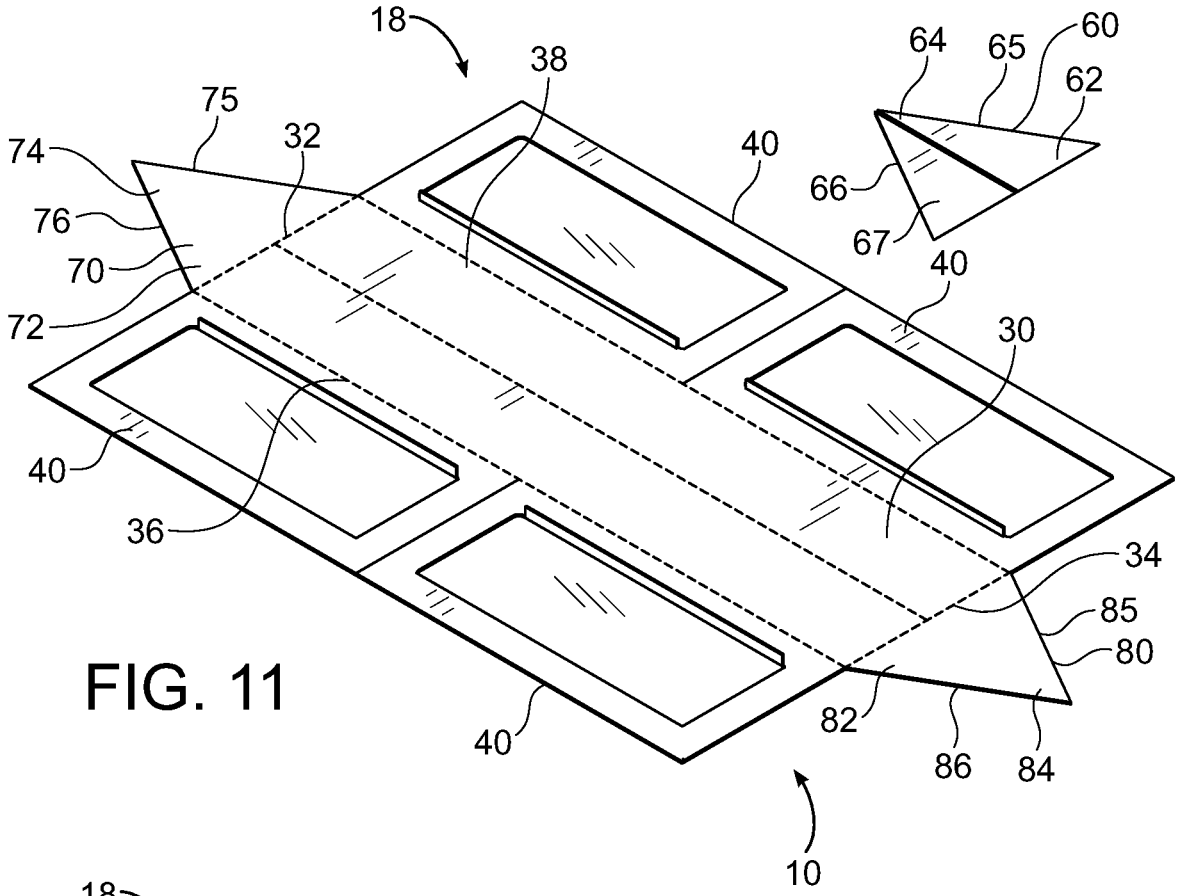
FIG. 11 is a top perspective view of an airplane tray cover multi-compartment holder system and method in accordance with an example embodiment illustrating a multi-compartment case in a pre-construction state.

A more preferred way best illustrated in FIGS. 11-15 is to "pre-assemble" some or all of the foregoing components of the case 10 as contiguous areas of a substantially flat "blank" 18 of foldable material, such as a paper-board or light-weight cardboard. As best illustrated in FIG. 11, the blank 18 preferably includes pre-formed fold and cut areas (illustrated as dotted lines) between the contiguous areas that define and distinguish the components and facilitate construction of the case 10.

Figure 12:
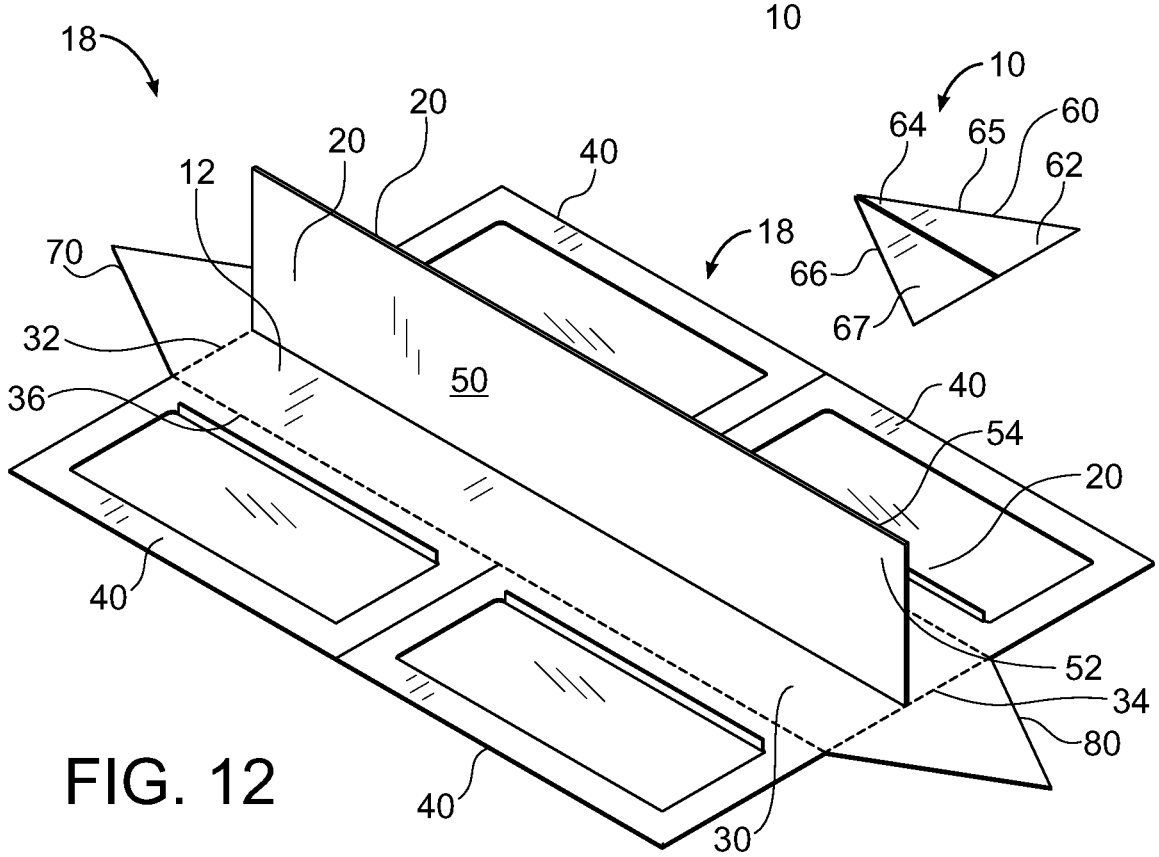
FIG. 12 is a top perspective view of an airplane tray cover multi-compartment holder system and method in accordance with an example embodiment illustrated in a partially constructed state with a center divider folded in place.

According to one method, the case 10 is constructed from the blank 18 by first folding the contiguous areas of the blank 18 corresponding to the first divider panel 50 upward along one or more parallel longitudinally extending pre-formed folds until approximately vertical to form the first divider panel 50 as illustrated in FIG. 12. This forms the bottom panel 30 on both sides of the first divider panel 50 at the same time.

Figure 13:
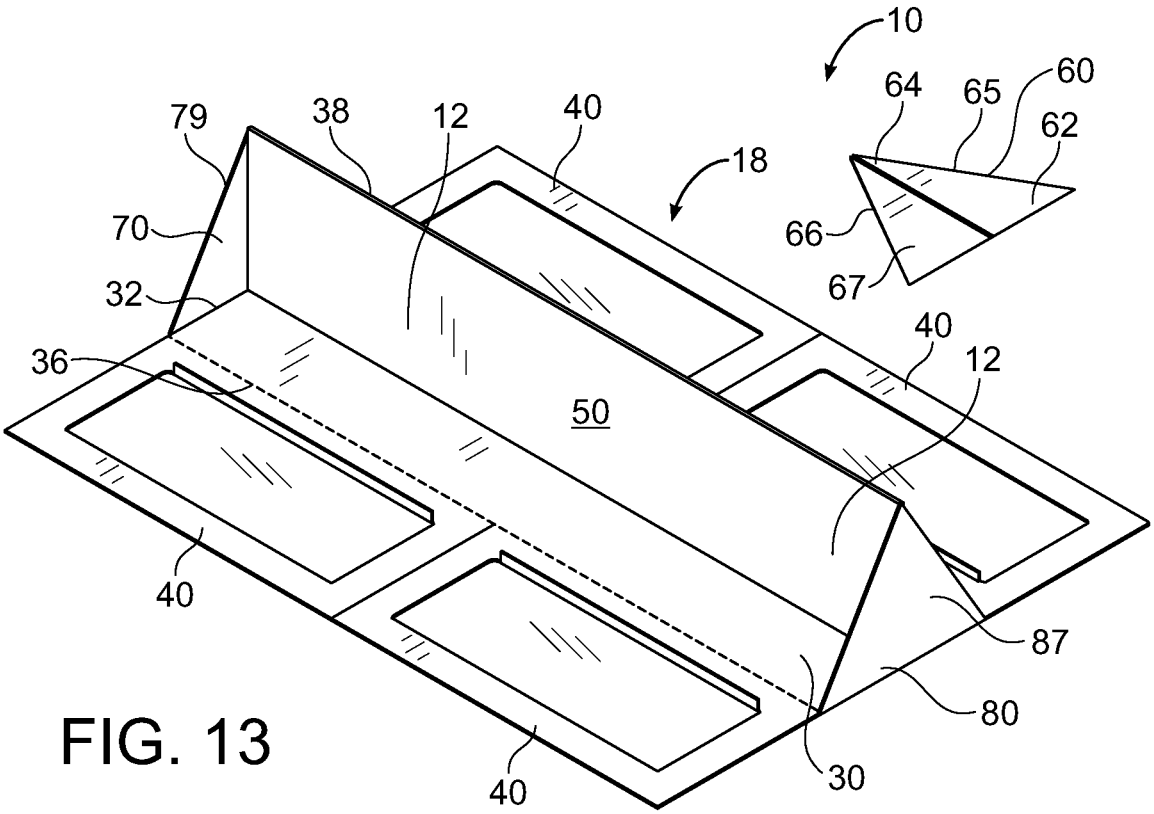
FIG. 13 is a top perspective view of an airplane tray cover multi-compartment holder system and method in accordance with an example embodiment illustrated in a partially constructed state with end panels folded in place.

Next, as illustrated in FIG. 13 the contiguous areas corresponding to the first and second end panels 70, 80 are folded upward along two pre-formed folds adjoining the area corresponding to the base panel 30 at opposite ends of and transverse to the first divider panel 50 until approximately vertical to form the first and second end panels 70, 80. The end panels 70, 80 also can be attached or connected to the opposite ends of the first divider panel 50 if necessary using a suitable adhesive or mechanical fastener.

Figure 14:
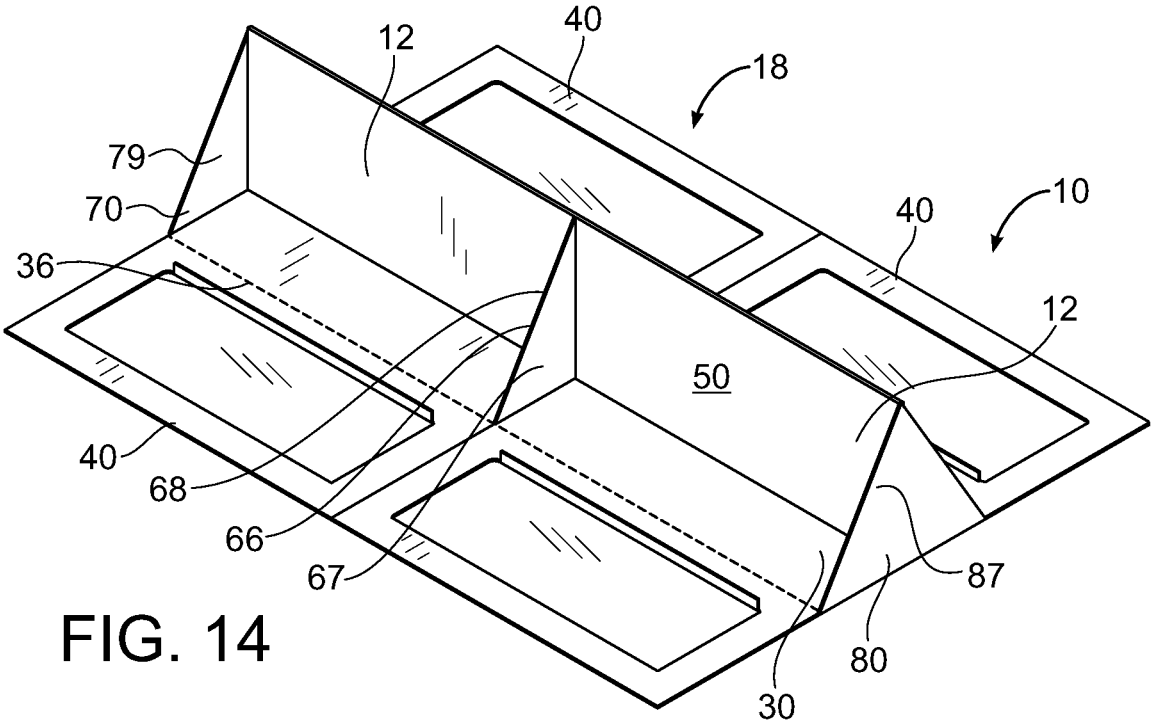
FIG. 14 is a top perspective view of an airplane tray cover multi-compartment holder system and method in accordance with an example embodiment illustrated in a partially constructed state with a transverse divider in place.

Next, the second divider panel 60 is inserted transversely through a pre-formed cut or slot in the first divider panel 50 as illustrated in FIG. 14. The second divider panel 60 may be attached or connected to the first divider panel 50 and/or the bottom panel 30 as necessary or desired using a suitable adhesive or mechanical fastener.

If desired, the end panels 70, 80 and/or the second divider panel 60 may be separately formed rather than integrally formed with the other components comprising the blank 18 so that the blank 18 does not become unduly complex to manufacture. For example, the end panels 70, 80 and/or the second divider panel 60 may be formed from a piece of material that is separate from the material comprising the blank 18 or as separate "punch out" areas of the same piece of material comprising the blank 18.

Next, the contiguous areas corresponding to the door panels 40 are folded upward and back toward the first divider panel 50 along longitudinal pre-formed folds adjoining the area corresponding to the bottom panel 30 to form the door panels 40 as illustrated in FIG. 15. The folds comprise the pivoting connection between the door panels 40 and bottom panel 30 of the case 10 Pre-formed cuts in the blank 18 separate the longitudinally adjacent door panels 40 on each side of the case 10.

Next, if desired and if a fold is provided, the top portion 43 of each door panel 40 may be folded inward toward the case 10 to create a flap for the connector 47. Finally, if connectors 47, 57, and 88 were not pre-assembled as part of the blank 18, they are connected or attached to the top portions of the door panels 40 and the first divider panel 50, as well as to each of the bottom panel 30, the first end panel 70, and the second end panel 80 in the locations described herein to complete construction of the case 10.

E. Another Example of a Multi-Compartment Case.

Figure 21:
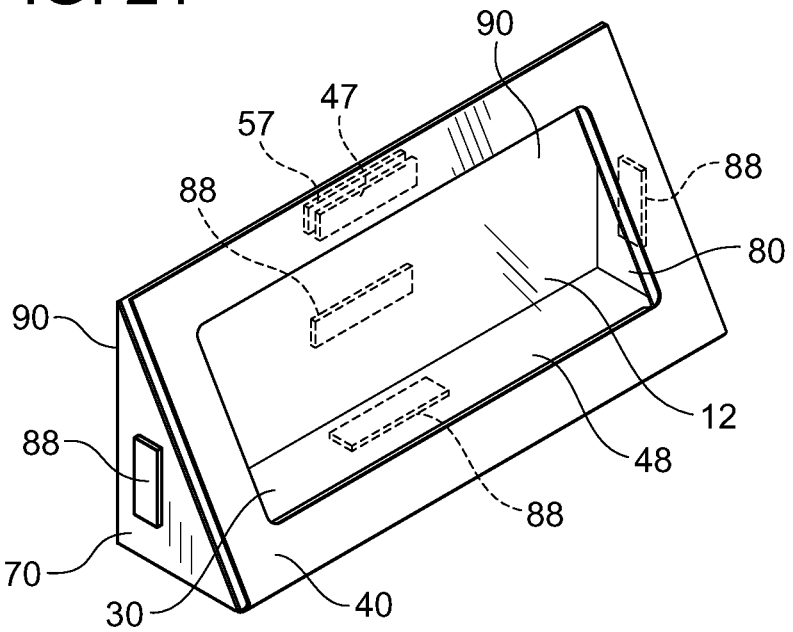
FIG. 21 is a perspective view of an airplane tray cover multi-compartment holder system and method in accordance with an alternative example embodiment illustrating an individual modular compartment with a door panel in a closed state.
Figure 22:
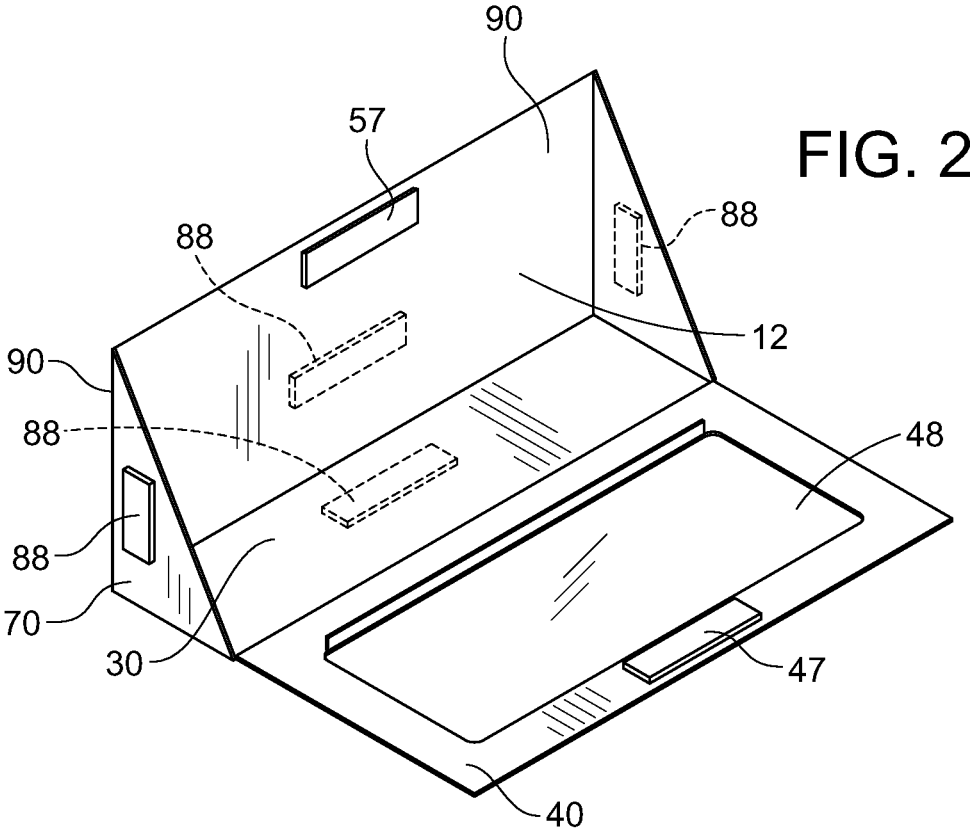
FIG. 22 is a perspective view of an airplane tray cover multi-compartment holder system and method in accordance with an alternative example embodiment illustrating an individual modular compartment with a door panel in an open state.
Figure 23:
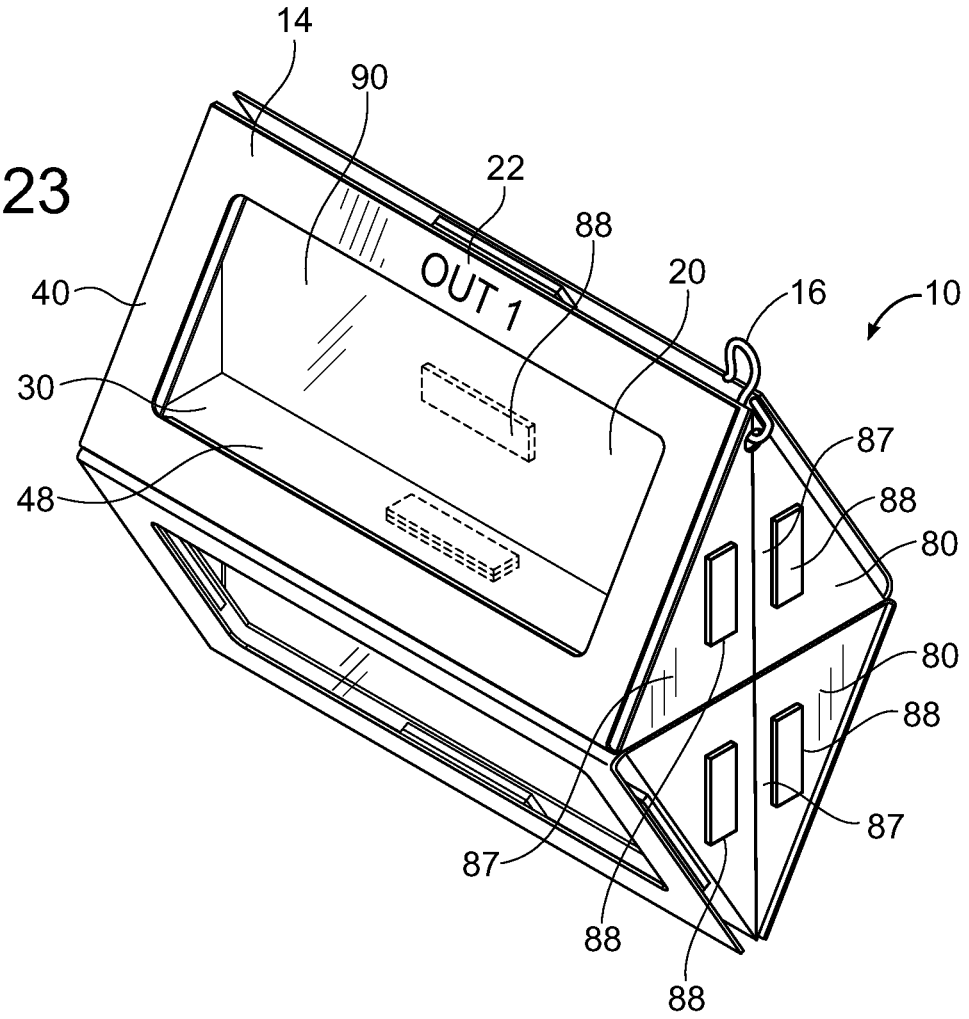
FIG. 23 is a perspective view of an airplane tray cover multi-compartment holder system and method in accordance with an alternative example embodiment illustrating four individual modular compartments connected together as a multi-compartment case having a quadrangular configuration.

In another example embodiment of an airplane tray cover multi-compartment holder system and method illustrated in FIGS. 21-23, a multi-compartment case 10 comprises a plurality of separate and individual modular compartments 20 that are releasably interconnected. One feature of this example embodiment is that it enables an individual modular compartment 20 to be offered and sold separately, perhaps in combination with a tray cover or other item in the compartment 20. A plurality of individual compartments 20 can then be interconnected to form the case 10 in a desired configuration at a later time and/or location as described further below.

In this embodiment, the case 10 may comprise two, four, or more individual compartments 20. For example, as illustrated in FIG. 23 the case 10 may comprise four substantially triangle-shape individual compartments 20 that are releasably inter-connected and arranged so that the case 10 has a substantially quadrangle-shape exterior profile and cross-section. Such a case 10 may measure for example approximately 4" in length, 2" in width, and 3.5" in height and each individual compartment 20 may measure about 4" in length, 1" in width, and approximately 1.7" in height.

With the foregoing dimensions the case 10 is well within the current standards of commercial airlines for luggage that may be carried on-board as described above. It is contemplated and will be appreciated, however, that the above-described dimensions are merely examples and that the case 10 may have other and different dimensions consistent with the objectives and purposes described herein. Moreover, as described further below this example embodiment of the case 10 may have various exterior and cross-sectional shapes, different dimensions, and different numbers of individual compartments 20 depending on the number and shape of the individual compartments 20 and how they are arranged and interconnected. All such variations are contemplated and are intended to be encompassed within the spirit and scope of the example embodiments described herein.

An example individual modular compartment 20 is best illustrated in FIGS. 21-22. The individual modular compartment 20 has substantially the same triangle-shape and may have approximately the same dimensions as each of the compartments 20 of the example embodiment of the case 10 previously described. Like the previously described compartments 20, each individual modular compartment 20 has an interior space 12 that is adapted to contain and hold an individual cover or item independent of and separate and isolated from other inter-connected modular compartments 20 and the individual covers or items therein to avoid cross-contamination between covers or items that may have already been used and those that have not yet been used.

Each modular individual modular compartment 20 is comprised of a bottom panel 30, a door panel 40, a first end panel 70, a second end panel 80, and a back panel 90. The bottom panel 30 and the first and second end panels 70, 80 are essentially the same as the corresponding components of the example embodiment of the case 10 previously described, except that they comprise only the portions of the corresponding components that define a single compartment 20. Also, unlike the previously described example embodiment in which the second divider panel 60 was between the first and second end panels 70, 80, in this embodiment, the first and second end panels 70, 80 directly face each other.

Similarly, the door panel 40 is essentially the same as the door panels 40 of the previously described example embodiment of the case 10. The door panel 40 also is pivotally connected or attached to the bottom panel 30 in the same manner as previously described, and functions in the same manner as previously described to enable a user to selectively open and close an individual modular compartment 20 to place or access a tray cover or other item therein. However, in this embodiment, the door panel 40 extends longitudinally along the side of the bottom panel 30 between the first and second end panels 70, 80, rather than between one of the end panels 70, 80 and the second divider panel 60.

In this example embodiment of the case 10, the back panel 90 effectively replaces the first divider panel 50 of the previously described example embodiment to the extent it defined a single compartment 20. The back panel 90 may have about the same dimensions as the portion of the first divider panel 50 it replaces. The back panel 90 has a top portion 92, a first surface 94 that faces the interior space 12 of the compartment 20, and a second surface 96 opposite the first surface 94 that faces the exterior of the compartment 20.

In this example embodiment of the case 10 as in the previously described example embodiment, the door panel 40 comprises a connector 47 at or near the top portion 43 of the door panel 40 that is adapted to releasably hold the door panel 40 in the closed state or position in relation to the compartment 20. Similarly to the first divider panel 50 it replaces, the top portion 92 of the back panel 90 has a corresponding connector 57 connected or attached in alignment with the connector 47 when the door panel 40 is in the closed state or position. The connector 47 and corresponding connector 57 thus releasably hold the door panel 40 to the back panel 90 with the top portion 43 of the door panel 40 adjacent to the top portion 92 of the back panel 90 when the door panel 40 is in the closed state. The connectors 47 and 57 may be connected or attached to the door panel 40 and to the back panel 90 respectively in the same manner previously described.

In this example embodiment of the case 10 as in the previously described example embodiment, the door panel 40 may comprise the window element 48 to enable a user to view a tray cover or other item in the individual modular compartment 20 without opening the door panel 40. Also as in the previously described example embodiment, the door panel 40 in this embodiment may comprise the support structure to engage and retain a portable electronic device in a viewable position for viewing by a user when the door panel 40 is in the open position.

Also as in the previously described embodiment, each individual modular compartment 20 preferably has the indicia 11 to uniquely identify the compartment 20 and distinguishing it from other individual modular compartments 20 to which it may be connected to form the case 10. The indicia 11 may be present on the door panel 40 and/or on one or more of the surfaces of the bottom panel 30, first end panel 70, the second end panel 80, and/or the 90 that define the individual modular compartment 20.

In this example embodiment of the case 10, one or more and preferably each of the bottom panel 30, the first end panel 70, the second end panel 80, and the back panel 90 have a connector 88 on their respective second (exterior) surfaces 33, 79, 89, 96 as previously described. The connectors 88 on the panels 30, 70, 80, and 90 make the compartment 20 modular and enable a user to selectively and releasably connect multiple individual and separate modular compartments 20 together end-to-end, bottom-to-bottom, and back-to-back or any combination thereof to form the case 10.

It will be appreciated that the individual modular compartments 20 may be interconnected in a plurality of ways to form this example embodiment of the case 10, and that therefore the case 10 may have a plurality of different exterior shapes, different cross-sections, and different numbers of compartments as desired by the user. It will also be appreciated that since the interior space 12 of each interconnected individual modular compartment 20 is combined to produce the total interior space of the case 10, the total interior space of this example embodiment of the case 10 is variable in that an indefinite number of individual modular compartments 20 can be interconnected.

For example, assuming that the individual modular compartments 20 are substantially triangle-shape as in the example embodiment described above, two such compartments 20 can be releasably connected back-to-back via the connectors 88 on their respective back panels 90 to form a two-compartment case 10 having a substantially triangle-shape. Two additional modular compartments 20 can be connected back-to-back with each other and connected bottom-to-bottom with the two other modular compartments 20 to form a four-compartment case 10 having a substantially quadrangle-shape, which may be substantially diamond- or square-shape, depending on whether the individual modular compartments 20 have isosceles or equilateral triangle shapes. Additional modular compartments 20 can be connected end-to-end with the other modular compartments to form an elongated case having eight or even more compartments and a variety of different exterior and cross-sectional shapes.

In this example embodiment of the case 10 as with the example embodiment previously described, it will be appreciated that the individual modular compartments 20 need not necessarily be triangle-shape and may have other cross-sectional shapes, including for example, round, half-round, quadrangle, or other polygon shapes. Also, depending on the shapes of the individual modular compartments 20, they can be interconnected in different ways to form cases 10 having a large number of exterior and cross-sectional shapes in addition to the examples described herein or that are possible with triangle-shape compartments 20. As one example in connection with the additional example embodiment described below, each individual modular compartment 20 could comprise a portion of a toroid, such as a half or a quarter thereof. Individual modular compartments 20 could then be releasably inter-connected to form a case 10 in the shape of a toroid.

Similar to the previously described example embodiment, in this example embodiment of the case 10 the individual modular compartments 20 can be constructed in a number of different ways. One way is to separately form the bottom panel 30, the door panel 40, the first end panel 70, the second end panel 80, and the back panel 90 and then assemble them together using suitable adhesive and/or mechanical fasteners to form the individual modular compartment 20.

A more preferred way is to "pre-assemble" some or all of the foregoing components as contiguous areas of a blank similar to the blank 18 previously described and fold the contiguous areas of the blank into the modular compartment 20 based on preformed folds.

For example, a flat bank could contain an area corresponding to the bottom panel 30 and contiguous areas around the bottom panel 30 corresponding to the door panel 40, the first and second end panels 70, 80, and the back panel 90. Preformed folds could be provided between the bottom panel 30 and each of the other components similar to the blank 18 previously described. The modular compartment 20 could then be constructed by first folding the areas corresponding to the first and second end panels 70, 80 and the back panel 90 upward from the area corresponding to the bottom panel 30 along the respective folds until they are substantially vertical, and then connecting them with suitable adhesive or mechanical fasteners. Then, the area corresponding to the door panel 40 may be folded upward along the fold adjoining the area corresponding to the bottom panel 30 and back toward the back panel 90. If the connectors 47, 57, and 88 are not pre-assembled as part of the blank, they may be attached to the door panel 40, end panels 70, 80, and back panel 90 respectively as described herein to complete construction of the modular compartment 20.

F. Another Example of a Multi-Compartment Case.

In another example embodiment of an airplane tray cover multi-compartment holder system and method illustrated in FIGS. 24-31, the multi-compartment case 10 is preferably shaped substantially as a toroid, more preferably as a toroidal polyhedron (multi-sided toroid), and still more preferably as a toroidal hexahedron (six-sided toroid). The toroidal-shape case 10 has an interior space with four separate and individual compartments 20 defined therein.

The case 10 comprises an outer frame 102, a first divider panel 112, a second divider panel 118, and a plurality of door panels 40. These elements are arranged to define a substantially toroid-shape interior space of the toroid-shape case 10 and to divide the interior space into four separate and individual compartments 20 with each compartment 20 having a corresponding door panel 40. More particularly, the elements divide the interior space into a first portion 114 with two compartments 20 and a second portion 116 with two compartments 20.

1. Interior Space Portions and Compartments.

Figure 27:
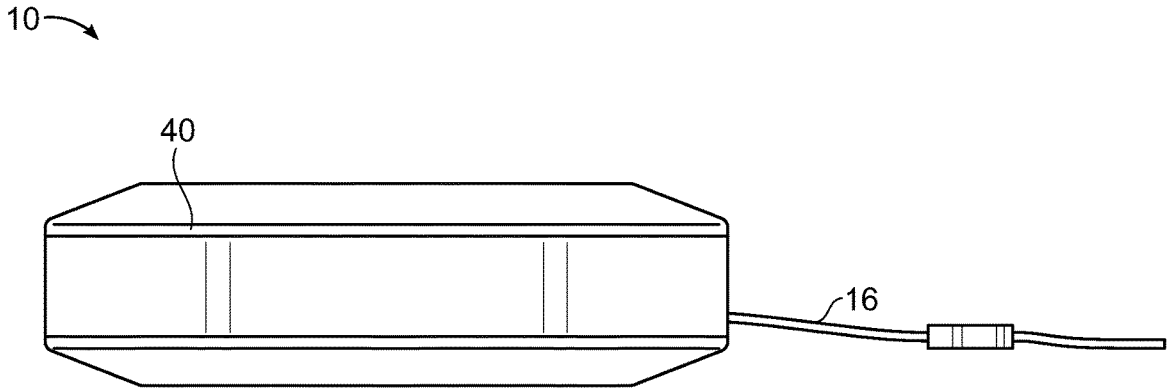
FIG. 27 is a side perspective view of an airplane tray cover multi-compartment holder system and method in accordance with another alternative example embodiment illustrating a toroidal-shape multi-compartment case with door panels closed.
Figure 30:
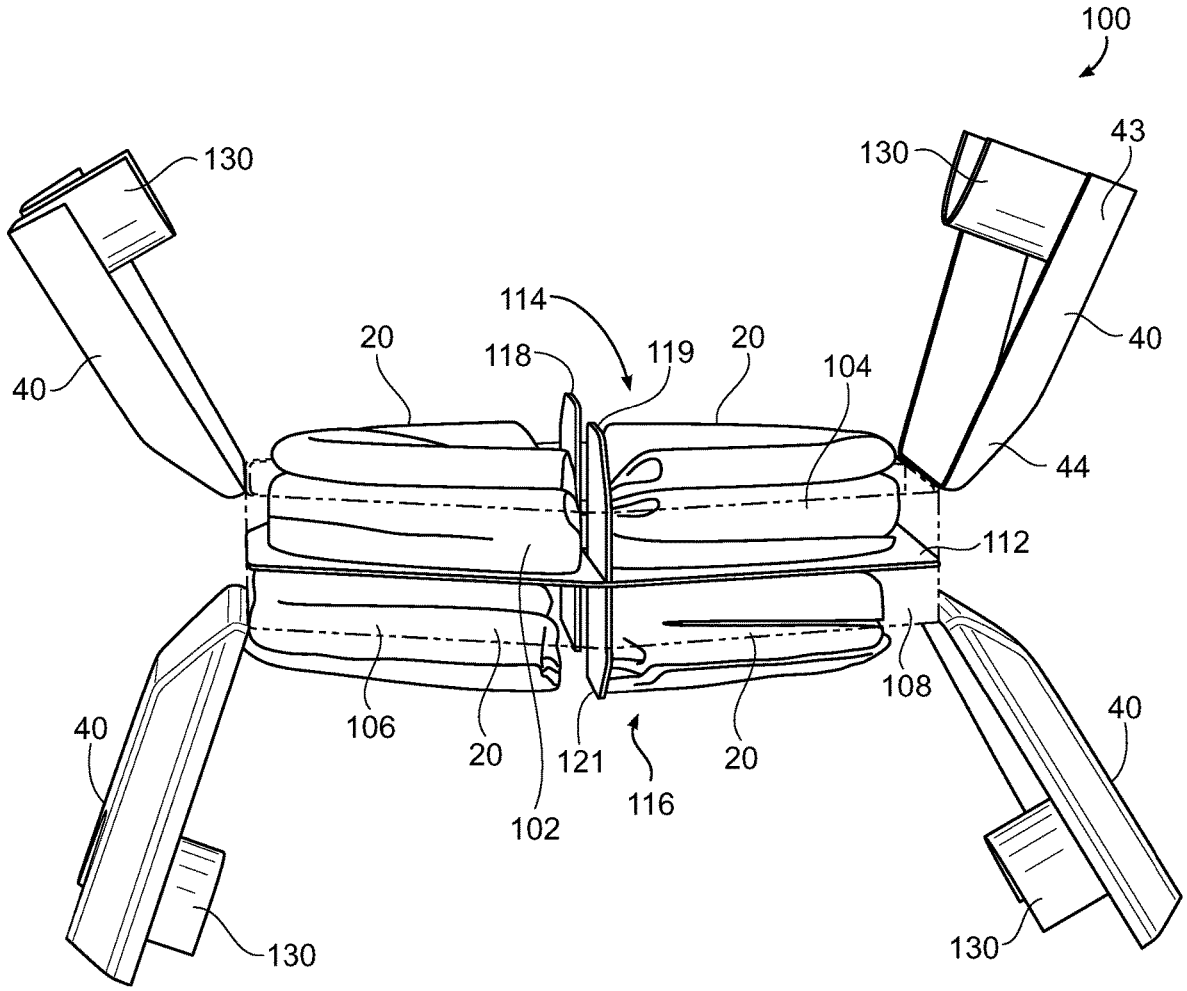
FIG. 30 is a side perspective view of an airplane tray cover multi-compartment holder system and method in accordance with another alternative example embodiment illustrating a toroidal-shape multi-compartment case partially transparent with all four door panels open.

The first portion 114 preferably comprises an upper or lower half or a left side or right side half of the toroid depending on how the case 10 is oriented, and the second portion 116 preferably comprises the opposite upper or lower half or left side or ride side half. For example, with the case 10 oriented as illustrated in FIG. 27 or FIG. 30, the first portion 114 comprises the upper half of the toroid-shape interior space and the second portion 116 comprises the lower half. With the case 10 rotated upward by ninety degrees, the first portion 114 comprises the left half of the toroid-shape interior space and the second portion 116 comprises the right half.

The two compartments 20 in the first portion 114 comprise opposite halves of the portion of the toroid comprising the first portion 114 and the two compartments 20 in the second portion 116 comprise opposite halves of the portion of the toroid comprising the second portion 116. Each of the two compartments 20 in the first portion 114 is arranged opposite a corresponding compartment 20 in the second portion 116. In this way, the compartments 20 are arranged symmetrically within the toroid-shape interior space, with each having substantially the same partially-toroidal shape, and with each being substantially the same size and comprising approximately a quarter of the entire interior space. It is contemplated and will be appreciated, however, that the elements of the case 10 may be arranged to define fewer or more compartments 20, and to define compartments 20 that are of different shapes and sizes. All such variations are within the scope and spirit of the example embodiment described herein.

2. Outer Frame.

The outer frame 102 comprises the outer periphery of the toroid-shape case 10. The outer frame 102 has a length or circumference dimension that determines the size of the overall footprint of the case 10 and a height or width dimension (depending on whether the case 10 is oriented horizontally or vertically) that substantially determines the depth or thickness of the case 10. Preferably the length or circumference dimension is substantially greater than the height or width dimension. In other words, the circumferential dimension and foot print of the case 10 are preferably substantially greater than the height, depth, or width dimension of the case 10. Being shaped as a toroid, the outer frame 102 has a central opening, a central axis that extends through the central opening substantially parallel with the height or width dimension of the outer frame, and an axial plane that is substantially perpendicular with the central axis and with the height or width dimension of the outer frame 102.

The outer frame 102 preferably comprises a thin single continuous sheet or piece of elongated substantially rectangular material. Alternatively, the outer frame 102 may be comprised of one or more separate panels, sections, or portions of the same elongated substantially rectangular shape that are attached together for example using suitable mechanical fasteners, adhesive, welds, or the like. In either case, the outer frame 102 is formed in the shape of the outer periphery of the toroid-shape case 10. To give the case 10 the shape of a toroidal polyhedron with a plurality of planar sides such as illustrated in FIGS. 24-26 and 28-31, for example, the material comprising the outer frame 102 may have bends formed therein at the intersections of the adjacent sides of the polyhedron. Alternatively, the outer frame 102 may be formed in the shape of the polyhedron from the beginning, for example by suitable molding and/or machining processes.

As best illustrated in FIGS. 24-26 and 28-29, the outer frame 102 is shaped as a toroidal hexahedron with six substantially planar sides. It is contemplated and will be appreciated however that the outer frame 102 may have other and different toroidal shapes including shapes without planar sides such as a true circular or tubular toroid and other toroidal polyhedron shapes with more or fewer planar sides. All such variations are within the scope and spirit of the example embodiment described herein.

The outer frame 102 comprises a first edge 104, a second edge 106 opposite the first edge 104, a first surface 108, and a second surface 110 opposite of the first surface 108. The first edge 104 comprises the upper or lower edge or the left or right edge of the toroid-shape case 10 depending on whether the case 10 is oriented horizontally or vertically. The second edge 106 comprises the opposite upper or lower edge or left or right edge of the case 10 again depending on how the case 10 is oriented. The first edge 104 also comprises an upper or lower or left or right edge of the compartments 20 in the first portion 114 of the interior space of the case 10 depending on whether the case 10 is oriented horizontally or vertically. The second edge 116 also comprises an upper or lower or left or right edge of the compartments 20 in the second portion 116 of the interior space of the case 10 again depending on how the case 10 is oriented.

The first surface 108 of the outer frame 102 faces the exterior of the case 10 and comprises an exterior side surface of the case 10. The second surface 110 faces the interior space of the case 10 and comprises an interior side surface of the case 10 as well an interior side surface of each of the compartments 20. More particularly, with the outer frame 102 shaped as a toroidal hexahedron and the compartments 20 arranged in the interior space as described above, the second surface 110 comprises a side surface of each compartment 20 that is shaped as a partial toroidal hexahedron corresponding to three adjacent sides of the toroidal hexahedron-shape outer frame 102.

3. First Divider Panel.

The first divider panel 112 preferably comprises a thin substantially flat planar sheet of material. The first divider panel 112 is arranged within the interior space of the case 10 so as to define and separate the first portion 114 and the second portion 116 of the interior space. The first divider panel 112 is preferably substantially parallel with the axial plane and substantially perpendicular to the central axis and to the height or width dimension of the outer frame 102. The first divider panel 112 extends outwardly from the central axis parallel to the axial plane in all directions substantially completely across the interior space of the case 10 between opposite points of the second (interior) surface 110 of the outer frame 102 (except as noted below). Preferably the first divider panel 112 joins with the second (interior) surface 110 of the outer frame 102 at substantially the mid-point of the height or width dimension. The first divider panel 112 thus halves or bisects the interior space of the case 10 parallel to the axial plane and perpendicular to the height or width dimension of the outer frame 102 and defines and separates the first portion 114 and the second portion 116 so that they are opposed and have substantially equal volumes. The first divider panel 112 can be considered a substantially horizontal interior floor or ceiling panel of each of the compartments 20 when the case 10 is oriented horizontally, and a substantially vertical interior side panel of each of the compartments 20 when the case 10 is oriented vertically.

The first divider panel 112 has a substantially circular opening that is substantially co-axial with the central axis of the outer frame 102. The opening comprises the central opening of the toroid-shape case 10. It is contemplated and will be appreciated however that the opening need not be circular and may have other cross-sectional shapes, such as square, rectangular, or another polygonal shape, including the same shape as the outer frame 102.

The first divider panel 112 may be formed as a single piece with the outer frame 102 for example by a suitable molding and/or machining process. Alternatively, the first divider panel 112 may comprise a separate piece and may be attached or connected to the outer frame 102 using suitable mechanical fasteners, adhesive, welding, tab and slot construction, or other suitable means.

4. Second Divider Panel.

The second divider panel 118 preferably comprises one or more thin substantially flat planar elongated sheets or pieces of material. The second divider panel 118 is arranged within the interior space of the case 10 so as to provide an interior side wall for each compartment 20 in the first portion 114 and the second portion 116 of the interior space.

The second divider panel 118 extends through the central axis of the outer frame 102 (except as noted below) between opposing points on the second (interior) surface 110 of the outer frame 102 in a plane that is substantially perpendicular to the plane of the first divider panel 112. The second divider panel 118 also extends substantially perpendicular to the plane of the first divider panel 112 across and/or through the first divider panel 112 between the first portion 114 and the second portion 116 of the interior space of the case 10. The second divider panel 118 has opposite side surfaces that face opposite points on the second (interior) surface 110 of the outer frame 102.

With this arrangement, the second divider panel 118 effectively halves or bisects the interior space of the case 10 substantially perpendicularly to the axial plane of the outer frame 102 and provides an interior side wall for each compartment 20 in the first portion 114 and each compartment 20 in the second portion 116 of the interior space of the case 10. The second divider panel 118 can thus be considered a substantially vertical side panel of each of the compartments 20 when the case 10 is oriented horizontally, and a substantially horizontal floor or ceiling panel of each of the compartments 20 when the case 10 is oriented vertically. The second divider panel 118 is interrupted by an opening that coincides with the substantially circular opening in the first divider panel 112.

To enable the second divider panel 118 to extend across and/or through the first divider panel 112 between the first portion 114 and the second portion 116 of the interior space of the case 10, suitable slots may be formed in the first divider panel 112 for the second divider panel 118 to extend through. Alternatively, the second divider panel 118 may comprise two separate sections and each section may be attached or connected to the surface of an opposite side of the first divider panel 112 with suitable mechanical fasteners, adhesive, welding, or the like. Also alternatively, the first and second divider panels 112, 118 may be formed as a single piece, for example using suitable molding and/or machining processes.

The second divider panel 118 has a first edge 119 and a second edge 121 that is opposite of the first edge 119. The first edge 119 is adapted to be adjacent to or in contact with portions of the interior surfaces of the two door panels 40 that correspond to the compartments 20 in the first portion 114 of the interior space of the case 10 when the door panels 40 are in the closed state. Similarly, the second edge 121 is adapted to be adjacent to or in contact with portions of the interior surfaces of the two door panels 40 that correspond to the compartments 20 in the second portion 116 of the interior space of the case 10 when those door panels 40 are in the closed state. The first and second edges 119, 121 act as stops for the door panels 40 to maintain proper spacing of the door panels 40 in relation to the outer frame 102 when the door panels 40 are in the closed state. The first and second edges 119, 121 also provide additional support to the door panels 40 to help prevent the panels from being inadvertently pushed or caved into the compartments 20, for example if something heavy is placed on them.

The second divider panel 118 may be dimensioned so that the first and second edges 119, 121 are spaced from the opposite surfaces of the first divider panel 112 by about the same distance as the first and second edges 104, 106 of the outer frame 102. However, the first and second edges 119, 121 respectively may be spaced a somewhat greater distance from the opposite surfaces of the first divider panel 112 than are the edges 119, 121 of the outer frame 102. This may be done to accommodate door panels 40 that are not substantially flat but that instead have a somewhat rounded or dome-like shape. Door panels 40 having such shapes can enclose an additional amount of interior space and effectively increase the space and volume of the individual compartments 20 when the door panels 40 are in the closed state. For example, as best illustrated in FIGS. 28-31 the door panels 40 may have somewhat rounded or dome-like shapes with downwardly beveled or sloped edge portions. When such a door panel 40 is moved to the closed position, the first or second edge 119, 121 of the second divider panel 118 are adjacent to or in contact with a portion of the interior surface of the door panel 40 that has the semi-rounded or dome shape while the downwardly sloped or beveled edges of the door panel 40 are adjacent to or in contact with the first or second edge 104, 106 of the outer frame 102. By being spaced an additional distance from the surfaces of the first divider panel 112, the first and second edges 119, 121 of the second divider panel 118 help maintain the proper spacing between the door panel 40 and the outer frame 102 when the door panel 40 is closed, and also provides additional support to prevent the door panel 40 from being pushed or caved in if something heavy is placed on it.

5. Door Panels.

Similar to the example embodiments of the case 10 previously described, each compartment 20 has a corresponding door panel 40. In this example embodiment, each door panel 40 preferably has a somewhat rounded or dome-like shape with rounded or beveled edge portions that extend outwardly and downwardly to side edges that are adapted and configured to be adjacent to or in contact with the first and second edges 104, 106 of the outer frame 102 when the door panels 40 are in the closed position. Also similar to the previously described example embodiments, each door panel 40 is separately and selectively movable between an open position as illustrated in FIGS. 28-30 and a closed position as illustrated in FIGS. 24-27. In the closed position each door panel 40 encloses a separate and individual compartment 20 of the case 10.

Similar to the door panels 40 of the previously described example embodiments, each door panel 40 comprises a top portion with a top edge and a bottom portion with a bottom edge opposite of the top portion and top edge. The top edges of the door panels 40 are adapted and configured to be adjacent to or in contact with the first edge 119 or the second edge 121 of the second divider panel 118 when the door panels 40 are in the closed position, depending on the compartment 20 to which the door panel 40 corresponds.

Figure 24:
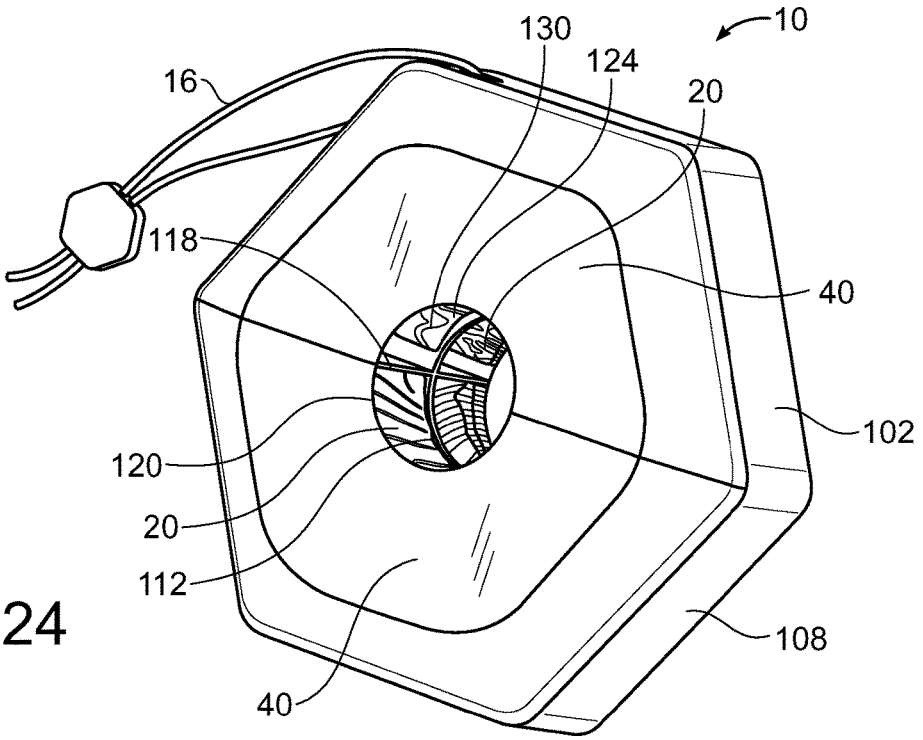
FIG. 24 is a perspective view of an airplane tray cover multi-compartment holder system and method in accordance with another alternative example embodiment illustrating a toroidal-shape multi-compartment case with door panels closed.
Figure 25:
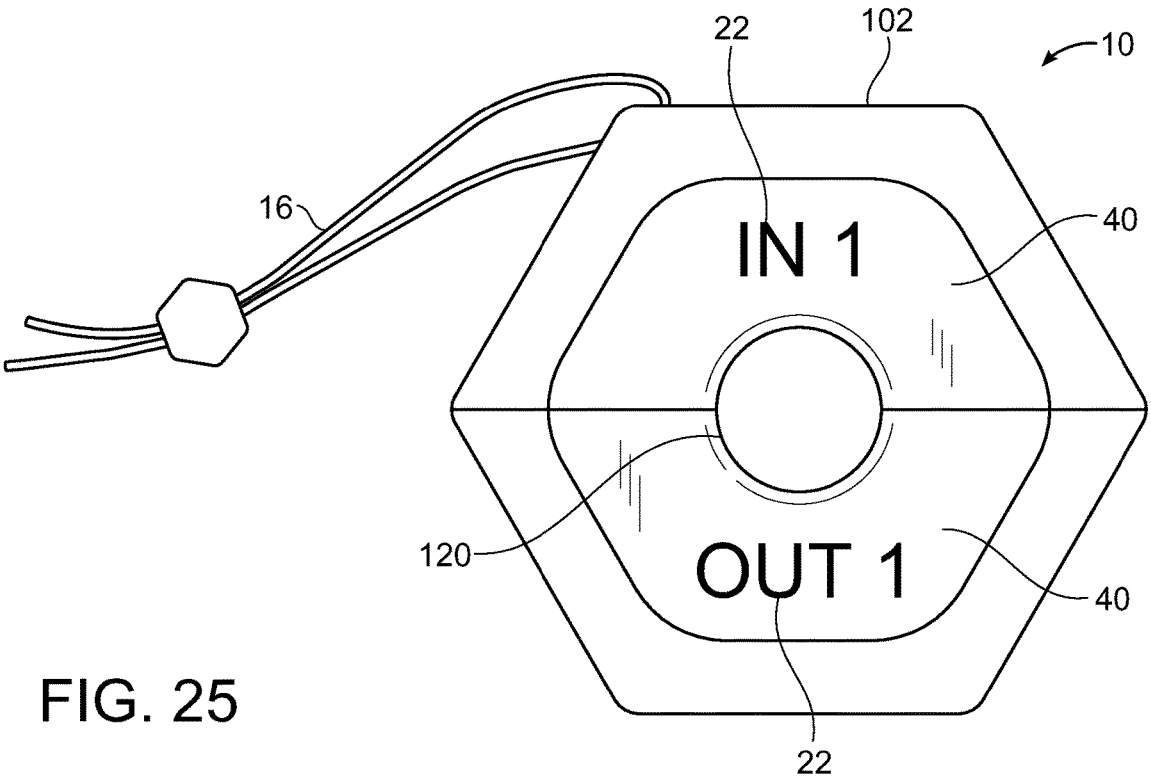
FIG. 25 is a top view of an airplane tray cover multi-compartment holder system and method in accordance with another alternative example embodiment illustrating a toroidal-shape multi-compartment case with door panels closed.
Figure 26:
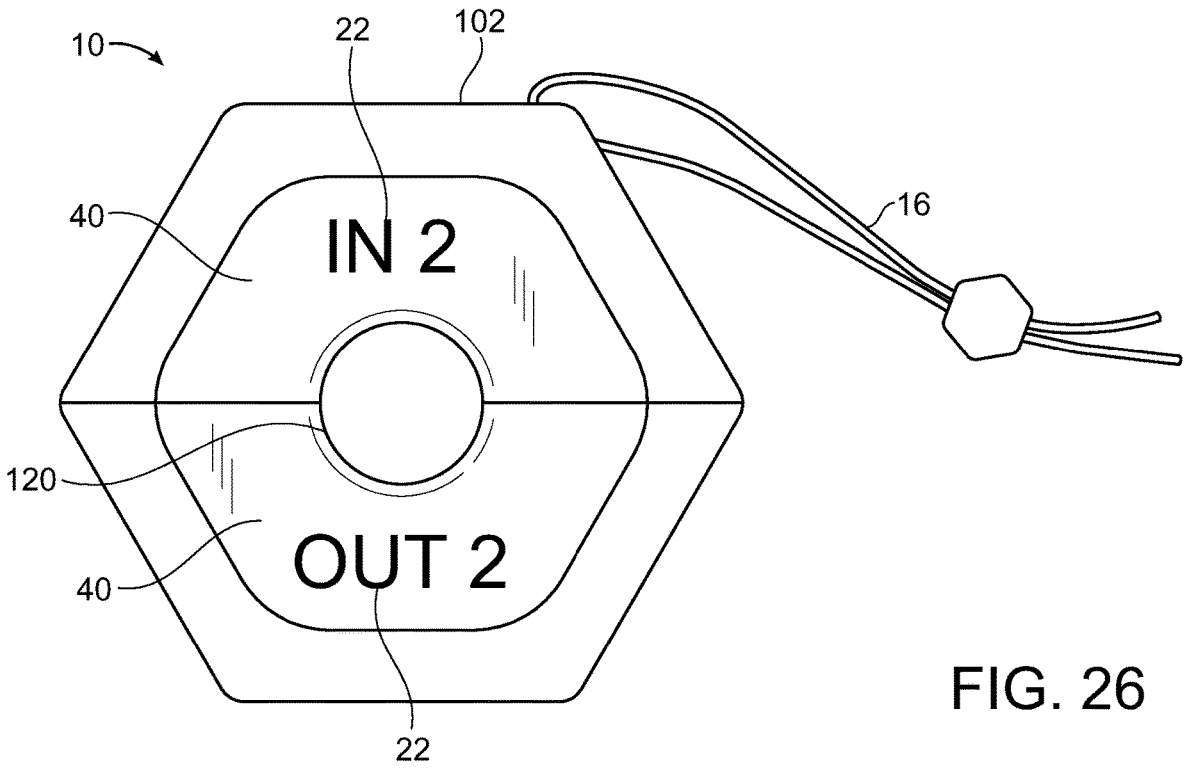
FIG. 26 is a bottom view of an airplane tray cover multi-compartment holder system and method in accordance with another alternative example embodiment illustrating a toroidal-shape multi-compartment case with door panels closed.
Figure 31:
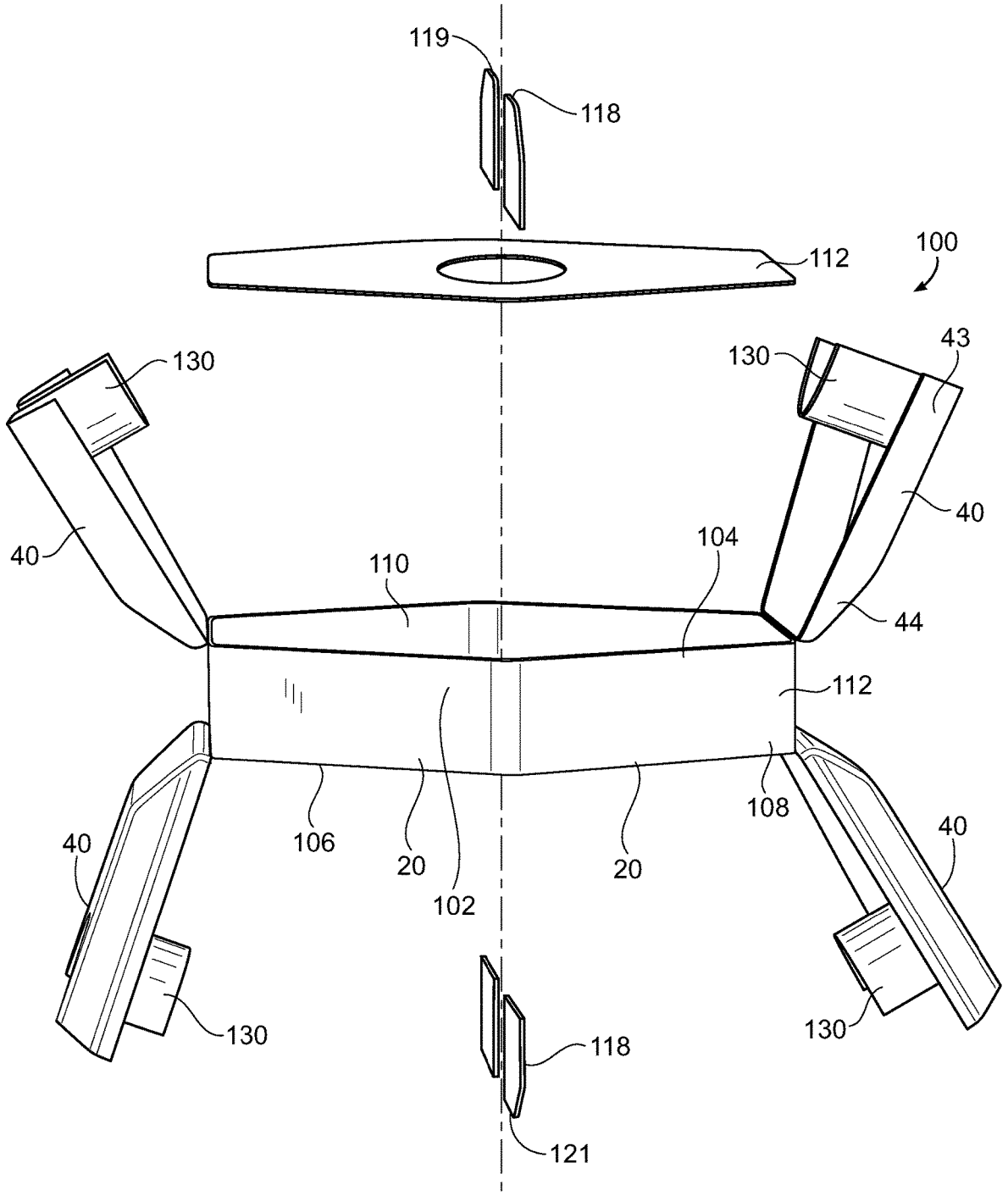
FIG. 31 is an exploded side perspective view of an airplane tray cover multi-compartment holder system and method in accordance with another alternative example embodiment illustrating a toroidal-shape multi-compartment case.

Each door panel 40 is pivotably connected or attached at or near its bottom edge to the first or second edge 104, 106 of the outer frame 102 of the case 10 depending on the compartment 20 to which the door panel 40 corresponds. More particularly, the two door panels 40 corresponding to compartments 20 in the first portion 114 of the interior space of the case 10 preferably have their respective bottom edges pivotably connected to the first edge 104 of the outer frame 102 on opposite sides of the toroid-shape frame 102. Similarly, the two door panels 40 corresponding to compartments 20 in the second portion 116 of the interior space of the case 10 preferably have their respective bottom edges pivotably connected to the second edge 106 the toroid-shape outer frame 102 on the same opposite sides. Accordingly, as illustrated in FIGS. 24-26 the two door panels 40 corresponding to the compartments 20 in the same first or second portion 114, 116 of the case 10 are arranged with their respective top edges facing and adjacent when the door panels 40 are in the closed state and the door panels 40 are pivotable in opposite directions between their respective closed and open positions. The door panels 40 corresponding to opposite compartments 20 in the first and second portions 114, 116 of the case 10 also are pivotable in the opposite direction between their respective closed and open positions. This arrangement enables all four door panels 40 to be pivotable outwardly from the outer frame 102 of the case 10 to the open position at the same time without interfering with each other as illustrated in FIGS. 30-31.

Similar to the previously described example embodiments, the door panels 40 in this example embodiment may be formed integrally with the outer frame 102 or may comprise separate structures that are connected or attached to the outer frame 102. When the door panels 40 are formed integrally with the outer frame 102, a crease or fold may be formed between the bottom edge of each door panel 40 and the first or second edge 104 106 of the outer frame 102 and may function as a hinge-type of pivotable connection. Alternatively, when the door panels 40 comprise separate structures from the outer frame 102, other forms of pivotable connections can be used including various types of hinges, rotating axles, etc.

Similar to the door panels 40 of the previously described example embodiments, each door panel 40 also comprises a first surface and a second surface 46 that is opposite of the first surface 45. When the door panel 40 is in the closed state, the first surface provides an interior surface of the individual compartment 20 to which the door panel 40 corresponds and the second surface provides a portion of the exterior surface of the case 10 that corresponds to the same individual compartment 20. The first and second surfaces preferably have the same somewhat rounded or dome-shape as described above for the door panel 40 to provide additional volume to the compartment 20 to which the door panel 40 corresponds when the door panel 40 is in the closed position.

As best illustrated in FIGS. 28-31, the first (interior) surface of each door panel 40 preferably comprises a projection, extension or protrusion 130 that projects, extends, or protrudes into the interior space of the case 10 and more particularly into the interior space of the compartment 20 to which the door panel corresponds when the door panel 40 is in the closed position.

The projection 130 comprises a first surface, a second surface that is opposite of the first surface, a first edge, and a second edge. The first surface generally faces toward the central axis of the toroid-shape case 10 and the central opening in the first divider panel 112 and comprises an exterior surface of the projection/window element 130 and of the case 10. The second surface faces the interior space of the case 10 and in particular the interior space comprising one of the four compartments 20. The second surface comprises an interior side surface of the compartment 20 to which the door panel 40 corresponds.

The projection 130 is shaped and dimensioned to substantially match the shape and dimension of the portion of the central opening in the first divider panel 112 that corresponds to the compartment 20 into which the projection/window element 130 projects. For example, if the central opening is circular and the portion that corresponds to the compartment 20 into which the projection/window element 130 projects is a semi-circle, then the projection/window element 130 projects is shaped as a semi-circle to match that portion of the central opening. However, as noted previously, it is contemplated that the central opening may have other shapes, and therefore the projection/window element 130 also may have other shapes matching those of the central opening.

When the door panel 40 is in the closed position, the projection 130 projects inwardly into the interior space of the compartment 20 to which the door panel 40 corresponds so that the first edge of the projection 130 is adjacent to or in contact with the circumferential edge of the central opening of the first divider 112 and the case 10. At the same time, the second edge of the projection 130 is adjacent to or in contact with an edge of the second divider panel 118 adjacent to the central opening and with a corresponding second edge of a corresponding projection 130 of a corresponding door panel 40 for the opposite compartment 20. With this arrangement, the door panel 40 fully encloses the compartment 20 to which the door panel 40 corresponds when the door panel 40 is in the closed position, and separates and isolates the compartment 20 from the exterior of the case 10 and from the other compartments 20 of the case with the compartments 20 spaced about the central opening of the toroid-shape case 10.

Each door panel 40 in this example embodiment preferably is shaped as a portion of a toroid, more particularly as a half toroid, and still more particularly as a half toroidal hexahedron. Thus, with the door panels 40 in the closed state, each separate individual compartment 20 comprises a space that is shaped substantially as a portion of a toroid and more particularly a portion of a toroidal hexahedron, and that is defined by a portion of the interior surface 110 of the outer frame 102, the interior surface of the projection 130, the interior surface of each of the first and second divider panels 112, 118, and the interior surface of the corresponding door panel 40. The space corresponding to each individual compartment 20 is thus separate and isolated from the exterior of the case 10, from the spaces corresponding to each of the other compartments 20 comprising the case 10. Potential cross-contamination between covers or other items in each of the compartments 20 is thus avoided.

Similar to the previously described example embodiments and as best illustrated in FIG. 24, because the projection 130 has a first surface that faces the exterior of the case 10 and a second surface that faces the compartments 20 in the interior space of the case 10, the projection 130 may comprise or may be provided with one or more window elements substantially the same as the window elements 48 described above. As previously described, the provision of window elements in the projections 130 allow a user to view the interior of each compartment 20 and the individual cover or other item contained therein without the need to open the corresponding door panel 40.

Also similar to the previously described example embodiments and as best illustrated in FIGS. 25-26 each door panel 40 of this embodiment may comprise an indicia that uniquely identifies the compartment 20 to which it corresponds and distinguishes it from the other compartments 20 of the case 10. Alternatively or in addition, the indicia may be present on one or more of the other panels or frame elements defining the compartments 20. Also similar to the previously described embodiments, each door panel 40 may comprise a window element 48 as previously described.

G. Operation of Preferred Embodiments.

In describing an example use of the airplane tray cover multi-compartment holder system and method, it will be assumed that an example embodiment of a multi-compartment case 10 has already been constructed as described herein or has been formed from individual modular compartments 20 constructed and interconnected as described herein. It is contemplated that each of the example embodiments described herein can be used in the same way.

In use, a user may simply move a door panel 40 of a selected compartment 20 from the closed position to the open position, insert an individual tray cover or other item into the selected compartment 20, then move the door panel 40 back to the closed position. The user may wish to make note of the indicia on the selected compartment 20 and/or the indicia on the tray cover or other item so that the user can later retrieve the same tray cover or other item from the same selected compartment 20 if desired. The user may repeat this process to insert individual covers or items into as many individual compartments 20 of the case 10 as desired.

As one potential alternative, a user may open one or more individual modular compartments 20, insert an individual tray cover or other item in each compartment 20, and then interconnect the individual modular compartments 20 to form the case 10. As another potential alternative, a user may acquire a case 10 having a plurality of compartments 20 each already containing an individual tray cover or other item. As yet another alternative, the user may acquire one or more individual modular compartments 20 each already containing an individual tray cover or other item and then interconnect the individual modular compartments 20 to form the case 10.

The user may then carry the case 10 containing the individual tray covers with the individual tray covers or other items independent of and isolated from each other in separate individual compartments 20, for example while the user travels aboard a commercial airplane. If desired, the user may attach the case 10 to a backpack or other piece of luggage using the attachment device 16.

When the user desires to access an individual tray cover or other item, the user may view the individual tray covers or other items in the individual compartments 20 through the window elements 48 and select a tray cover or other item, for example based on the indicia 11 on the tray cover or item, the indicia 22 on the compartment 20 holding the selected cover or item, or another basis. The user then moves the door panel 40 of the selected compartment 20 to the open position, retrieves the selected tray cover or other item from the selected compartment 20, and moves the door panel 40 back to the closed position. The user may wish to note the indicia 11, 22 on the selected cover or other item and/or the selected compartment 20 to facilitate the user returning the selected cover or other item to the same compartment 20 after use in order to avoid potentially cross-contaminating other clean, unused covers or items. Again, this process may be repeated to select, access and retrieve as many individual tray covers or other items from the case 10 as desired.

When the user is finished using an individual tray cover or other item and wishes to return it to the case 10, the user again selects a compartment 20 of the case 10, preferably the same compartment 20 from which the used tray cover or other item was originally retrieved. Selection of the same compartment 20 may be facilitated by the user recalling the indicia 22 on the compartment 20 from which the cover or item was retrieved. The user simply opens the door panel 40 of the selected compartment 20, inserts the used cover or other item in the selected compartment 20, and closes the door panel 40. Again, this process may be repeated to return as many times as desired to return used covers or other items to the case 10. By returning used covers or other items to the same compartments 20 from which they were initially retrieved, contact with clean, unused tray covers or other items in other compartments 20 and potential cross-contamination of the clean tray covers or other items is avoided.

If desired, while a door panel 40 of a selected compartment 20 is in the open position the user can rest a portable electronic device, such as a cell phone, against the case 10 in an upwardly inclined viewable position with an edge of the device engaged and supported by the support structure on the exposed surface of the open door panel 40. The user may thus watch a movie, check email, etc. The case 10 preferably sits on a tray cover fitted on a fold down seat back tray table and is held in place and prevented from sliding or otherwise moving by corresponding connectors on the tray cover and the bottom panel 30 of the case 10 as described herein.

When a user is finished traveling, the user may retrieve the used tray covers or other items from the case 10 in the same manner described above and wash or otherwise sanitize them for future use. The user may and preferably does also wash or otherwise sanitize the case 10 and each of the individual compartments 20. The user may return the sanitized tray covers or other items to the sanitized compartments 20 of the case 10 for storage if desired, or may store them separately from the case 10. If multiple cases 10 were connected to form a multi-case structure or if multiple individual modular compartments 20 were interconnected to form a case 10, the user may choose to disconnect the cases 10 and/or modular compartments 20 in the manner described herein to store them for future use. Alternatively, for some contemplated embodiments it is envisioned the user will dispose of the case 10 or modular compartments 20 in a suitable fashion.

Unless otherwise defined, all technical and scientific terms used herein have the same meaning as commonly understood by one of ordinary skill in the art to which this invention belongs. Although methods and materials similar to or equivalent to those described herein can be used in the practice or testing of the airplane tray cover multi-compartment holder system and method, suitable methods and materials are described above. All publications, patent applications, patents, and other references mentioned herein are incorporated by reference in their entirety to the extent allowed by applicable law and regulations. The airplane tray cover multi-compartment holder system and method may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method of using a case having a first compartment and a second compartment, wherein the case has a toroidal polyhedron shape with a central opening, wherein the first compartment has a first window in the central opening, and wherein the second compartment has a second window in the central opening, wherein the first compartment and the second compartment are each isolated, wherein the first compartment includes a first door panel for selectively opening and closing the first compartment, wherein the second compartment includes a second door panel for selectively opening and closing the second compartment, wherein a first airplane tray cover that is unused is initially positioned within the first compartment, and wherein a second airplane tray cover that is unused is initially positioned within the second compartment, said method comprising the following steps in order:

a) opening the first door panel of the first compartment;
b) removing the first airplane tray cover from the first compartment;
c) positioning the first airplane tray cover from the first compartment on a first airplane tray of a first airplane;
d) removing the first airplane tray cover from the first airplane tray of the first airplane;

e) repositioning the first airplane tray cover that potentially has been contaminated into the first compartment to avoid cross-contamination with the second airplane tray cover;

f) closing the first door panel of the first compartment;

g) opening the second door panel of the second compartment;

h) removing the second airplane tray cover from the second compartment;

i) positioning the second airplane tray cover from the second compartment on a second airplane tray of a second airplane;

j) removing the second airplane tray cover from the second airplane tray of the second airplane;

k) repositioning the second airplane tray cover that potentially has been contaminated into the second compartment to avoid cross-contamination with the first airplane tray cover; and l) closing the second door panel of the second compartment.

2. The method of claim 1, wherein the first airplane is for an outgoing flight and wherein the first compartment includes a first indicia that uniquely identifies the first compartment as being associated with the outgoing flight for repositioning the first airplane tray cover into the first compartment to avoid cross-contamination with the second airplane tray cover.

3. The method of claim 2, wherein the second airplane is for a return flight and wherein the second compartment includes a second indicia that uniquely identifies the second compartment as being associated with the return flight for repositioning the second airplane tray cover into the second compartment to avoid cross-contamination with the first airplane tray cover.

4. The method of claim 1, wherein the first window is within the first door panel and wherein the second window is within the second door panel.

5. The method of claim 1, wherein the case includes an attachment device adapted to removably attach the case to a piece of luggage.

6. A method of using a case having a plurality of compartments, wherein the case has a toroidal polyhedron shape with a central opening, and wherein the plurality of compartments are arranged around the central opening, wherein each of the plurality of compartments is isolated from one another, wherein each of the plurality of compartments initially contains an airplane tray cover that is unused and pretreated with an antibacterial or antimicrobial agent, wherein each the plurality of compartments includes a door panel that is selectively openable and closable, and wherein each of the plurality of compartments includes a window, comprising the following steps in order:

a) opening a first door panel of a first compartment of the plurality of compartments;

b) removing a first airplane tray cover from the first compartment;

c) positioning the first airplane tray cover from the first compartment on a first airplane tray for use;

d) after use, removing the first airplane tray cover from the first airplane tray;

e) repositioning the first airplane tray cover that potentially has been contaminated into the first compartment to avoid cross-contamination with any other airplane tray cover in any other compartment of the plurality of compartments; and f) closing the first door panel of the first compartment.

7. The method of claim 6, wherein each of the plurality of compartments has an indicia that uniquely identifies and distinguishes it from every other compartment of the plurality of compartments for repositioning the airplane tray cover in a corresponding compartment the airplane tray cover was removed from.

8. The method of claim 6, wherein each airplane tray cover in each compartment has an indicia that uniquely identifies it and distinguishes it from every other airplane tray cover in every other compartment.

9. The method of claim 6, wherein the window of each compartment of the plurality of compartments is exposed in the central opening.

10. The method of claim 6, wherein the case includes an attachment device adapted to removably attach the case to a piece of luggage.

11. A method of using a case having a plurality of compartments, wherein the case has a toroidal polyhedron shape with a central opening, wherein each of the plurality of compartments is isolated from one another, wherein each of the plurality of compartments initially contains an airplane tray cover that is unused and pretreated with an antibacterial or antimicrobial agent, wherein each the plurality of compartments includes a door panel that is selectively openable and closable, wherein each of the plurality of compartments includes a window, and wherein the window of each compartment of the plurality of compartments is exposed in the central opening, comprising the following steps in order:

a) opening a first door panel of a first compartment of the plurality of compartments;

b) removing a first airplane tray cover from the first compartment;

c) positioning the first airplane tray cover from the first compartment on a first airplane tray for use;

d) after use, removing the first airplane tray cover from the first airplane tray;

e) repositioning the first airplane tray cover that potentially has been contaminated into the first compartment to avoid cross-contamination with any other airplane tray cover in any other compartment of the plurality of compartments; and f) closing the first door panel of the first compartment.

12. The method of claim 11, wherein each of the plurality of compartments has an indicia that uniquely identifies and distinguishes it from every other compartment of the plurality of compartments for repositioning the airplane tray cover in a corresponding compartment the airplane tray cover was removed from.

13. The method of claim 11, wherein each airplane tray cover in each compartment has an indicia that uniquely identifies it and distinguishes it from every other airplane tray cover in every other compartment.

14. The method of claim 11, wherein the case includes an attachment device adapted to removably attach the case to a piece of luggage.

* * * * *